US010621845B2

(12) United States Patent
Shimazu

(10) Patent No.: US 10,621,845 B2
(45) Date of Patent: Apr. 14, 2020

(54) ALARM DEVICE

(71) Applicant: HOCHIKI Corporation, Tokyo (JP)

(72) Inventor: Tomohiko Shimazu, Tokyo (JP)

(73) Assignee: HOCHIKI CORPORATION, Tokyo (JP)

( * ) Notice: Subject to any disclaimer, the term of this patent is extended or adjusted under 35 U.S.C. 154(b) by 0 days.

(21) Appl. No.: 16/044,351

(22) Filed: Jul. 24, 2018

(65) Prior Publication Data

US 2019/0147717 A1 May 16, 2019

Related U.S. Application Data

(63) Continuation-in-part of application No. PCT/JP2016/081584, filed on Oct. 25, 2016.

(30) Foreign Application Priority Data

| | | |
|---|---|---|
| Oct. 26, 2015 | (JP) | 2015-210083 |
| Nov. 9, 2015 | (JP) | 2015-219764 |
| Nov. 11, 2015 | (JP) | 2015-221522 |
| Nov. 20, 2015 | (JP) | 2015-227679 |
| Dec. 1, 2015 | (JP) | 2015-234712 |
| Dec. 1, 2015 | (JP) | 2015-234713 |

(51) Int. Cl.

| | |
|---|---|
| ***G08B 17/00*** | (2006.01) |
| ***G08B 17/113*** | (2006.01) |
| ***G08B 17/06*** | (2006.01) |
| ***G08B 17/107*** | (2006.01) |
| ***G08B 29/04*** | (2006.01) |
| *G08B 17/10* | (2006.01) |

(52) U.S. Cl.
CPC ..... *G08B 17/113* (2013.01); *G08B 17/06* (2013.01); *G08B 17/107* (2013.01); *G08B 29/043* (2013.01); *G08B 17/10* (2013.01)

(58) Field of Classification Search
None
See application file for complete search history.

(56) References Cited

U.S. PATENT DOCUMENTS 3,708,675 A * 1/1973 Tashiro ..... G01N 21/53 250/574
4,171,486 A * 10/1979 Dobrzanski ..... G08B 17/113 250/381

(Continued)

FOREIGN PATENT DOCUMENTS

CN 1271916 11/2000
CN 2469508 Y 1/2002

(Continued)

OTHER PUBLICATIONS

English translation of International Search Report for International Application No. PCT/JP2016/081584.

(Continued)

*Primary Examiner* — Julie B Lieu
(74) *Attorney, Agent, or Firm* — Blank Rome LLP

(57) ABSTRACT

Provided is an alarm device which is attached to an installation surface of an installation object and has an installation surface side facing surface facing an installation surface, the alarm device including detection means for detecting smoke included in a gas, a casing accommodating the detection means, and guide means for guiding a gas into the casing.

24 Claims, 15 Drawing Sheets

(56) References Cited

U.S. PATENT DOCUMENTS

| | | | | |
|---|---|---|---|---|
| 5,751,218 | A * | 5/1998 | Winterble | G08B 17/107 340/628 |
| 2002/0154018 | A1* | 10/2002 | Nishikawa | G08B 17/107 340/630 |
| 2009/0021729 | A1* | 1/2009 | Iguchi | G01N 21/53 356/246 |
| 2010/0079299 | A1* | 4/2010 | Hoshino | G08B 17/107 340/628 |
| 2011/0068936 | A1* | 3/2011 | Shimada | G08B 17/10 340/584 |
| 2013/0093594 | A1 | 4/2013 | Brigham et al. | |
| 2015/0030375 | A1* | 1/2015 | Kawaguchi | G01D 11/30 403/19 |
| 2017/0268994 | A1* | 9/2017 | Kawai | G01N 15/06 |

FOREIGN PATENT DOCUMENTS

| | | | |
|---|---|---|---|
| CN | 102314743 | | 1/2012 |
| EP | 1049061 | A2 | 11/2000 |
| EP | 2402920 | A2 | 1/2012 |
| JP | S55-7658 | | 1/1980 |
| JP | H10241074 | A | 9/1998 |
| JP | 2010-039936 | A | 2/2010 |
| JP | 2011-186643 | A | 9/2011 |
| JP | 2013-525897 | | 6/2013 |

OTHER PUBLICATIONS

Li, I-min, Designs and Maintenance Manual for Atmospheric Pollution Control Apparatus, 1993, p. 129.

* cited by examiner

ALARM DEVICE

TECHNICAL FIELD

This application is a Continuation-In-Part of International Application No. PCT/JP2016/081584, filed on Oct. 25, 2016, which claims priority to Japanese Patent Application No. 2015-210083 filed Oct. 26, 2015, Japanese Patent Application No. 2015-221522 filed Nov. 11, 2015, Japanese Patent Application No. 2015-219764 filed Nov. 9, 2015, Japanese Patent Application No. 2015-227679 filed Nov. 20, 2015, Japanese Patent Application No. 2015-234712 filed Dec. 1, 2015, Japanese Patent Application No. 2015-234713 filed Dec. 1, 2015, the content of all of which is incorporated herein by reference.

BACKGROUND ART

Conventionally, there has been known an alarm which is provided on a lower surface of a ceiling of a monitoring area and generates an alarm by detecting smoke in the monitoring area. This alarm includes a casing which accommodates a circuit board or the like of an alarm circuit and a detector which detects smoke. However, in this alarm, since the detector is provided to be exposed to the outside of the casing, the alarm has a complicated appearance and thus has a possibility that the appearance of the monitoring area may be deteriorated. For this reason, in recent years, there has been a request for improving the design property of the alarm in order to improve the appearance of the monitoring area provided with the alarm.

Here, an alarm in which a detector is accommodated in a casing is proposed (for example, Patent Document 1). In the alarm, an opening is provided at a side wall of the casing, smoke is allowed to flow into the casing through the opening, and the smoke flowing into the casing is detected by the detector. Then, in the alarm, vertical and horizontal bars crossing each other are provided at the opening in order to reinforce the casing.

CITATION LIST PATENT DOCUMENT

Patent Document 1: JP-A-2010-39936

SUMMARY OF THE INVENTION TECHNICAL PROBLEM

It is an object of the present invention to solve the problems of the above mentioned prior arts.

One aspect of the present invention provides an alarm device that is attached to an installation surface of an installation object and has an attachment surface facing the installation surface, the alarm device comprising, detection means for detecting a detection target material included in a gas; accommodation means for accommodating the detection means; and guide means for guiding the gas into the accommodation means.

MODE FOR CARRYING OUT THE INVENTION

Hereinafter, an embodiment of an alarm device according to the invention will be described in detail with reference to the drawings. Additionally, the invention is not limited to the embodiment.

[Basic Concept of Embodiment]

First, a basic concept of an embodiment will be described. The embodiment schematically relates to an alarm device which is attached to an installation surface of an installation object, that is, an alarm device which has an attachment surface facing the installation surface.

Here, the "alarm device" is a device for generating an alarm. Specifically, the alarm device is a device which generates an alarm for a detection target material included in a gas of a monitoring area and is, for example, a concept including a gas alarm and a fire alarm (a smoke alarm). The "monitoring area" is a monitoring object area. Specifically, the monitoring area is an area provided with the alarm device and is, for example, a concept including an area (for example, a room or the like) inside a house and an area inside a building other than the house. Further, the "installation object" is an object to be provided with the alarm device and is, for example, a ceiling, a wall, or the like inside the monitoring area. Further, the "installation surface" is a surface of the installation object provided with the alarm device and is, for example, a surface at the side of the monitoring area of the ceiling (that is, a lower surface of the ceiling), a surface at the side of the monitoring area of the wall (that is, an indoor side surface of the wall), or the like. Further, the "attachment surface" is a surface provided in the alarm device and is, specifically, a surface attached to the installation surface while facing the installation surface. Further, the "detection target material" is a material of a detection object. Specifically, the detection target material is a material included in a gas and is, for example, a concept including carbon monoxide, smoke, and the like in a gas.

In the following embodiment, a case will be described in which the "detection target material" is "smoke", the "alarm device" is a "fire alarm (a smoke alarm)" based on scattered light due to smoke, and the "monitoring area" is a "room corresponding to an area in the house". Further, the "installation object" may be the "ceiling" or the "wall" as described above, but a case in which the "installation object" is the "wall" will be appropriately described while showing a case in which the "installation object" is the "ceiling" as below.

(Configuration)

Figure 1:
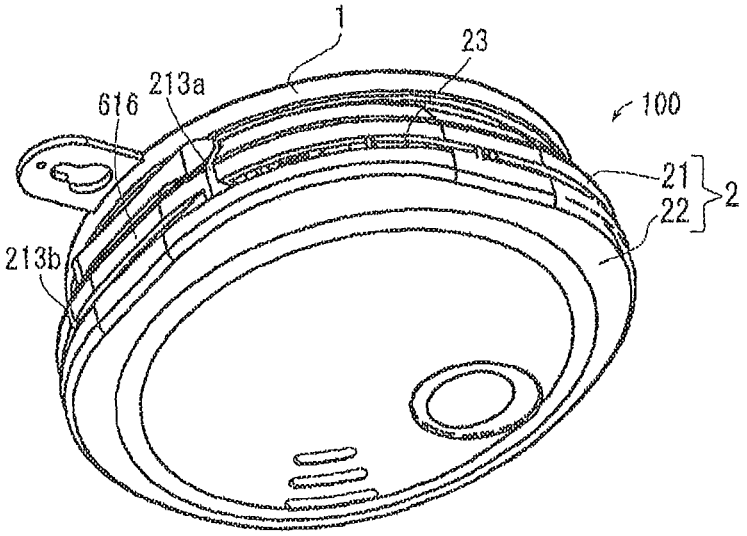
FIG. 1 is a perspective view of an alarm device according to an embodiment.
Figure 2:
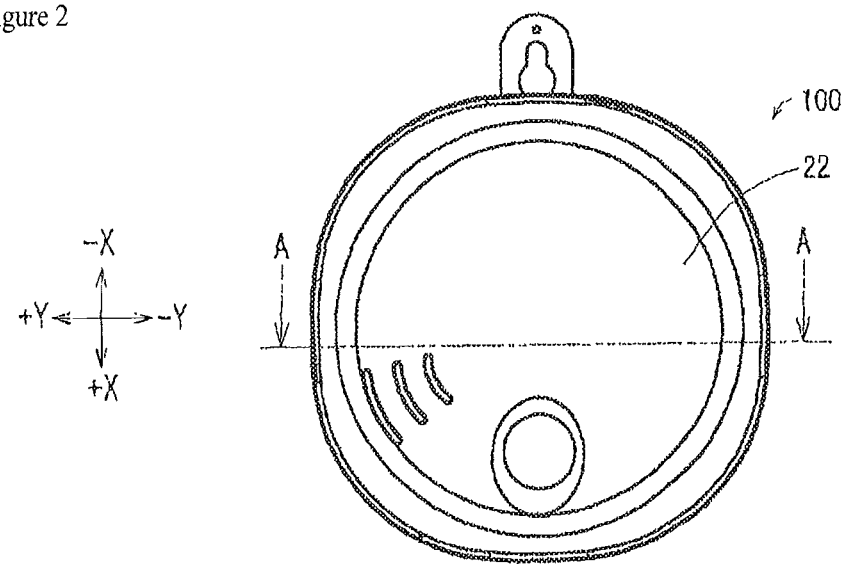
FIG. 2 is a bottom view of the alarm device.
Figure 3:
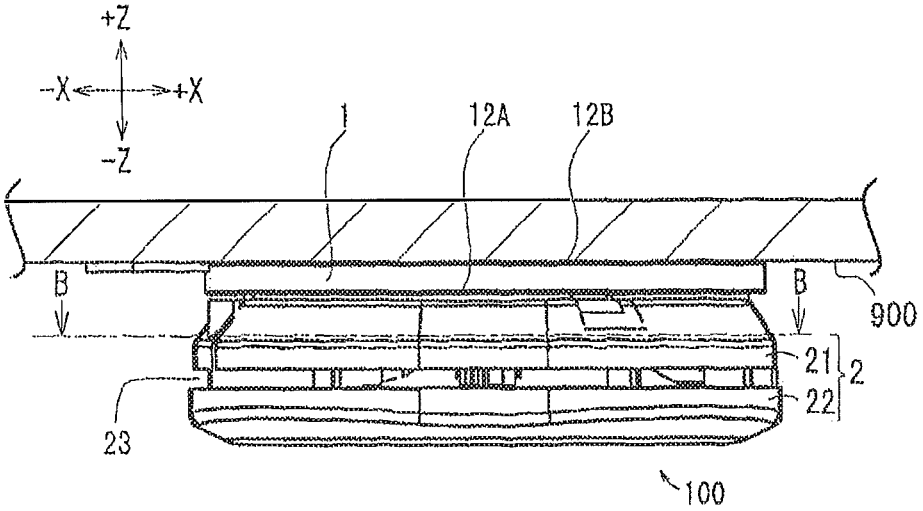
FIG. 3 is a side view of the alarm device.
Figure 4:
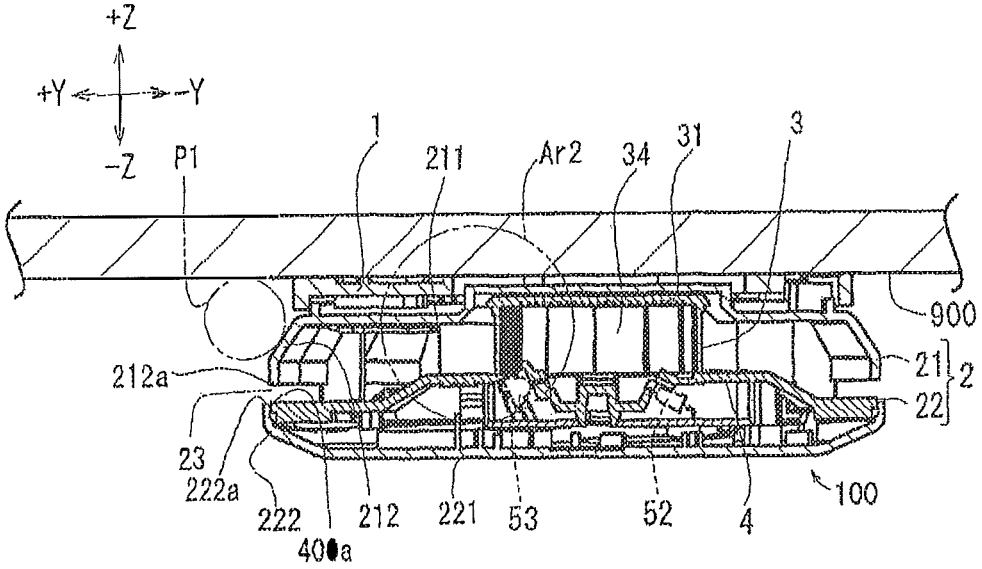
FIG. 4 is a cross-sectional view taken along the line A-A of FIG. 2.
Figure 5:
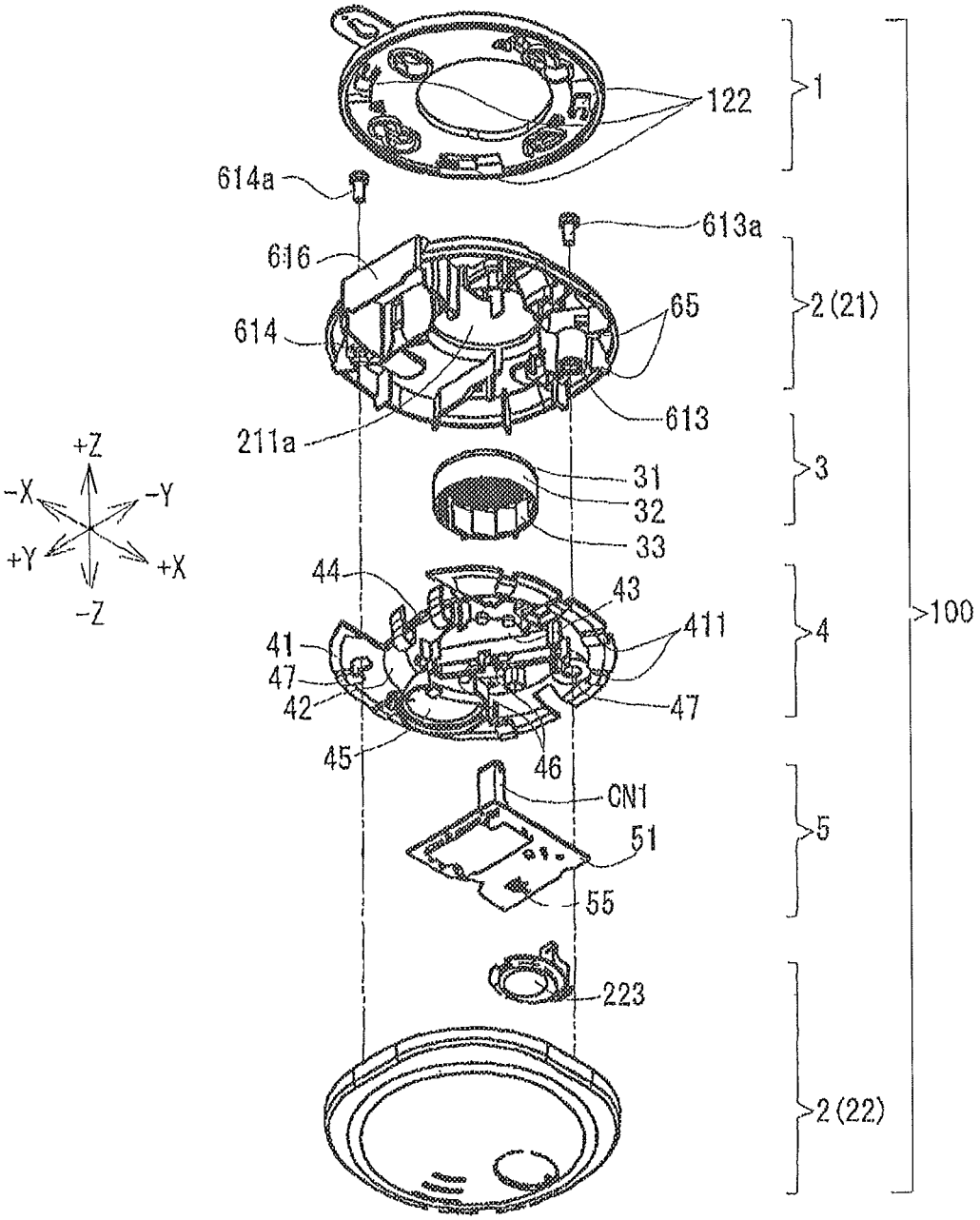
FIG. 5 is an exploded perspective view of the alarm device when viewed from the lower side
Figure 6:
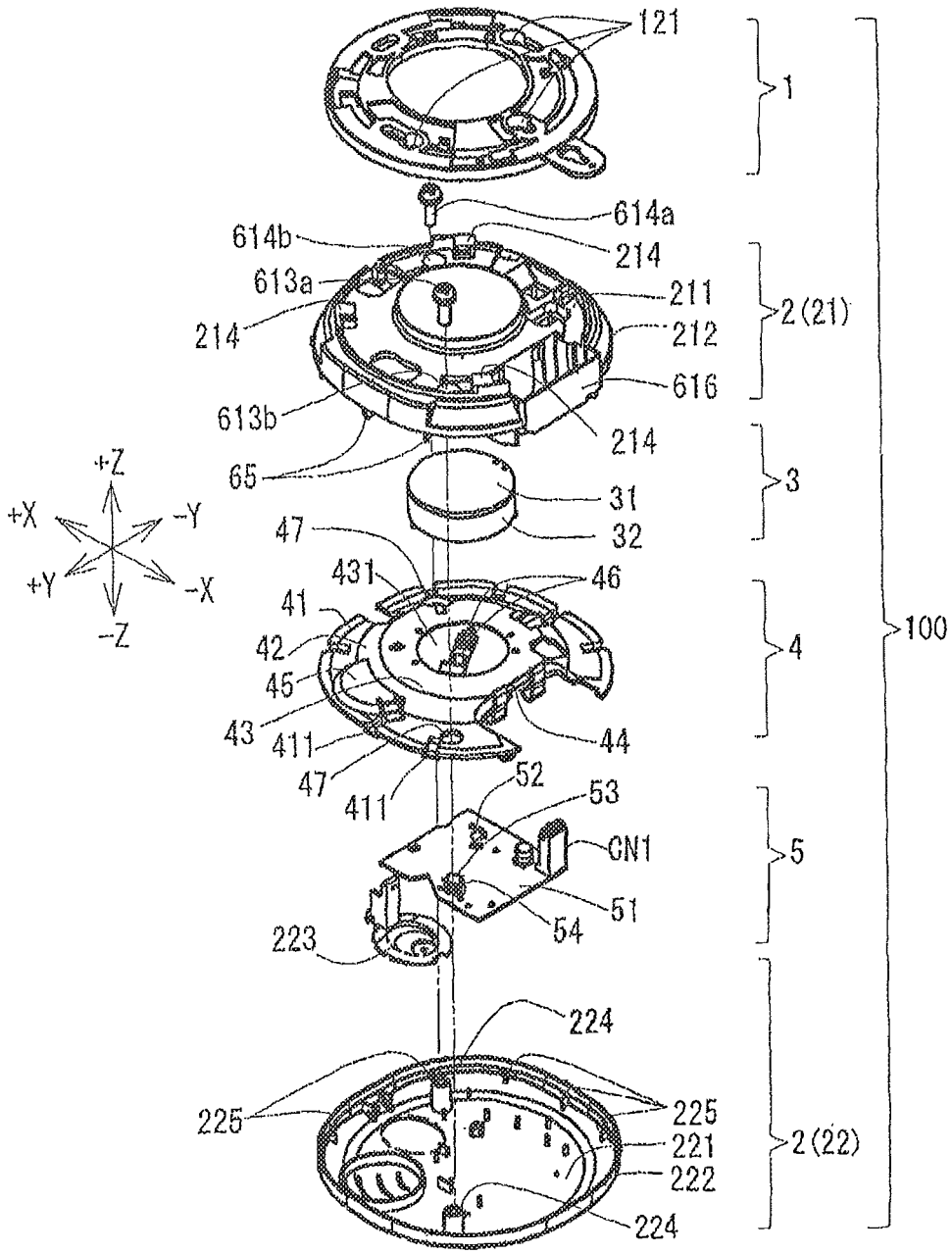
FIG. 6 is an exploded perspective view of the alarm device when viewed from the upper side

First, a configuration of the alarm device according to the embodiment will be described. FIG. 1 is a perspective view of the alarm device according to the embodiment, FIG. 2 is a bottom view of the alarm device, FIG. 3 is a side view of the alarm device, FIG. 4 is a cross-sectional view taken along the line A-A of FIG. 2, FIG. 5 is an exploded perspective view of the alarm device when viewed from the lower side, and FIG. 6 is an exploded perspective view of the alarm device when viewed firm the upper side. Additionally, in the following description, a description will be made on the assumption that X-Y-Z illustrated in the drawings are orthogonal to one another, specifically, the Z direction is the vertical direction (that is, the gravity action direction) and the X direction and the Y direction are the horizontal directions orthogonal to the vertical direction. For example, the Z direction will be referred to as the height direction, the +Z direction will be referred to as the upper side (top surface), and the −Z direction will be referred to as the lower side (bottom surface). For the terms relating to the "X-Y-Z direction" below, in order to illustrate a relative positional relationship of components of the alarm device 100 illustrated in the drawings for convenience of description, hereinafter, a direction moving away from a detection space 34 will be referred to as the "outside" and a direction moving close to the detection space 34 will be referred to as the "inside" with reference to the center position of the detection space 34 of the casing 2 of FIG. 4.

The alarm device 100 illustrated in the drawings is alarm means which detects smoke corresponding to a detection target material included in a gas. Specifically, as illustrated in FIG. 3, the alarm device is used while being attached to an installation surface 900 which is a surface (that is, a lower surface) at the lower side (the −Z direction) of the ceiling of the monitoring area or an installation surface (not illustrated) (hereinafter, a wall installation surface) which is a surface at the side of the monitoring area in the wall of the monitoring area (that is, an indoor side surface of the wall). Specifically, the alarm device includes an attachment base 1, a casing 2, a detector cover 3, a detector body 4, and a circuit unit 5 of FIG. 5. Hereinafter, a case will be described in which the installation surface 900 is widened in the direction along the XY plane (that is, the horizontal direction) and the "wall installation surface (not illustrated)" is widened in a direction orthogonal to the installation surface 900 (that is, the vertical direction). Hereinafter, an entire configuration of the alarm device 100 will be described and then a detailed configuration thereof will be described.

(Configuration-Attachment Base)

Figure 7:
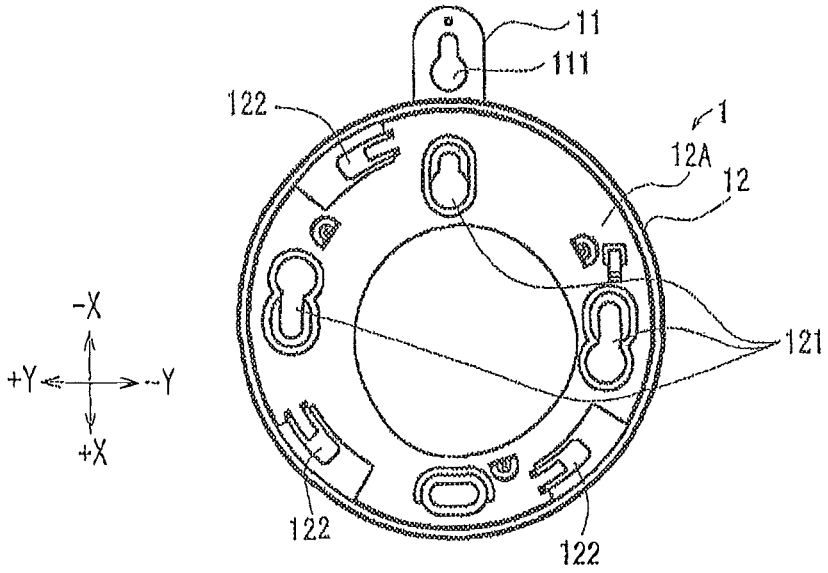
FIG. 7 is a bottom view of an attachment base.
Figure 8:
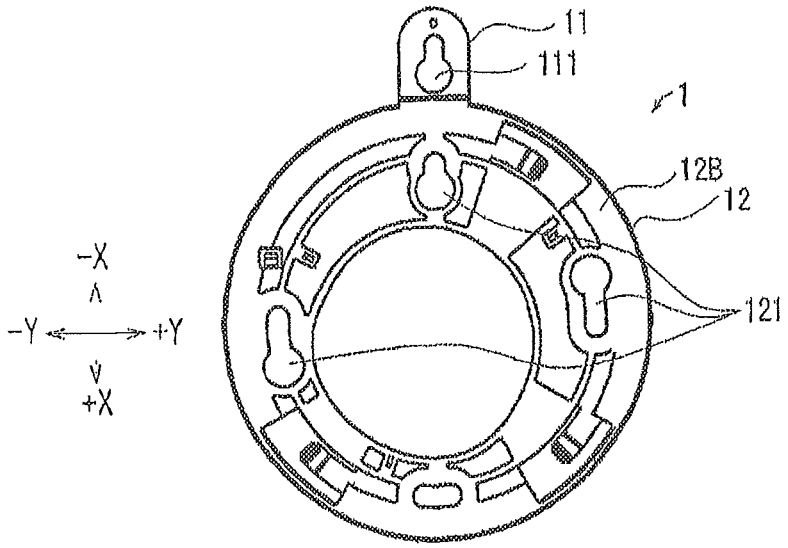
FIG. 8 is a plan view of the attachment base.

First, FIG. 7 is a bottom view of the attachment base and FIG. 8 is a plan view of the attachment base. The attachment base 1 illustrated in FIG. 3 is attachment means for attaching the casing 2 to the installation surface 900 or the "wall installation surface (not illustrated)". Specifically, the attachment base is used between the casing 2 and the installation surface. 900 or the "wall installation surface (not illustrated)" and, more specifically, includes an attachment hook 11 and a main body 12 of FIG. 7.

(Configuration-Attachment Base-Attachment Hook)

The attachment hook 11 of FIG. 7 is used to attach (that is, install) the attachment base 1 to the installation surface 900 or the "wall installation surface (not illustrated)" and is, specifically, a protrusion protruding from the main body 12 and including, for example, a threaded hole 111. The threaded hole 111 is a hole through which an attachment screw (not illustrated) for attaching the attachment base 1 is inserted. Then, when the attachment screw is continuously inserted into the threaded hole 111 and the installation surface 900 or the "wall installation surface (not illustrated)", the attachment base 1 can be attached to the installation surface 900 or the "wall installation surface (notillustrated)".

(Configuration-Attachment Base-Main Body)

The main body 12 of FIG. 7 is a main body of the attachment base 1 and has, for example, a disk shape having a predetermined diameter and widened in the direction along the XY plane. The main body is integrally formed with the attachment hook 11 by resin and includes, more specifically, a casing side facing surface 12A and an installation surface side facing surface 12B of FIG. 8. As illustrated in FIG. 3, the casing side facing surface 12A of FIG. 7 is a surface to which the casing 2 is attached while facing the casing 2 and the installation surface side facing surface 12B is a surface to which attached to the installation surface 900 while facing the installation surface 900 (that is, an installation surface widened in the direction along the XY plane). Further, the main body 12 includes a threaded hole 121 and an engagement portion 122 as illustrated in FIG. 7. The threaded hole 121 is a hole through which an attachment screw (not illustrated) for attaching the attachment base 1 to the installation surface 900 is inserted. Then, when the attachment screw is continuously inserted through the threaded hole 121 and the installation surface 900, the attachment base 1 can be attached to the installation surface 900. Further, the engagement portion 122 is attachment means to which the casing 2 of FIG. 3 is attached and, specifically, engages with an engagement portion 214 of the rear casing 21 to be described later in FIG. 6. The outer diameter of the main body 12 can be arbitrarily set, but the outer diameter will be described as below such that the outer diameter is set to be substantially the same as, for example, the existing attachment base (for example, about 10 cm).

(Configuration-Casing)

Next, the casing 2 of FIG. 3 is accommodation means for accommodating the detector cover 3, the detector body 4, and the circuit unit 5 (hereinafter, accommodation objects) of FIG. 5. Specifically, the casing is attached to the installation surface 900 through the attachment base 1 and includes, more specifically, a rear casing 21 and a front casing 22 of FIG. 5.

(Configuration-Casing-Rear Casing)

Figure 9:
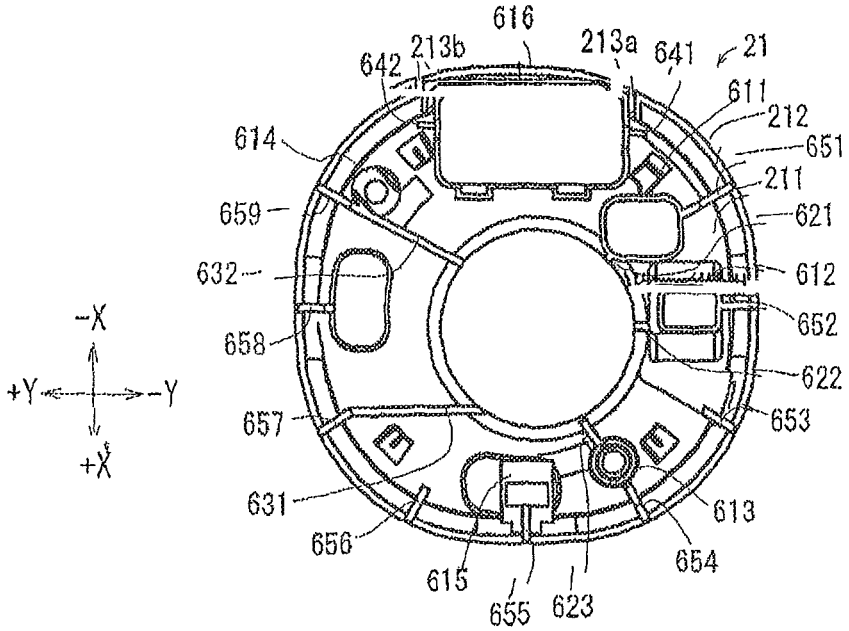
FIG. 9 is a bottom view of a rear casing.
Figure 10:
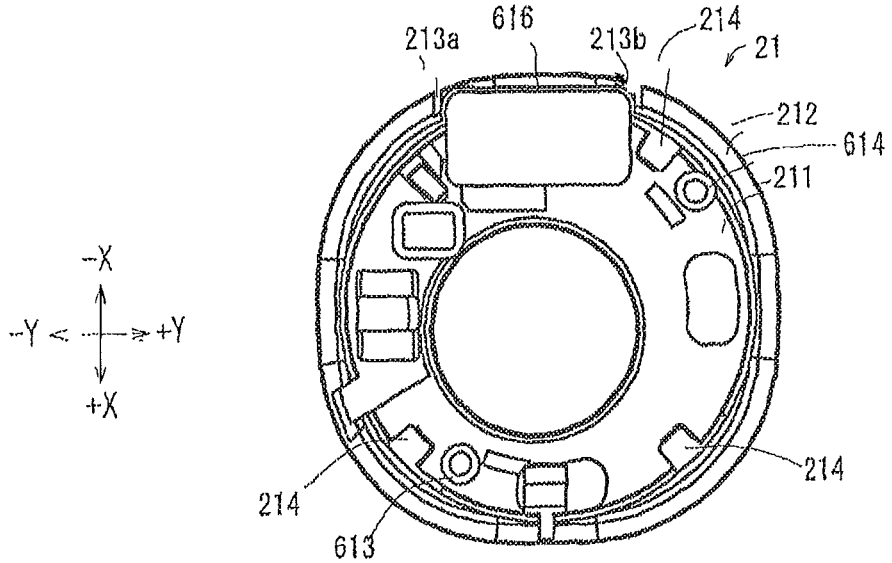
FIG. 10 is a plan view of the rear casing.
Figure 11:
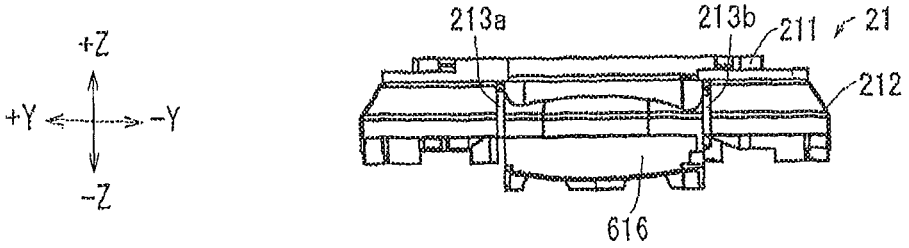
FIG. 11 is a front view of the rear casing.

FIG. 9 is a bottom view of the rear casing, FIG. 10 is a plan view of the rear casing, and FIG. 11 is a front view of the rear casing. As illustrated in FIG. 5, the rear casing 21 in these drawings is first accommodation means (one accommodation means) for accommodating the "accommodation object" from the side of the attachment base 1 (that is, the upper side (the +Z direction)) and is combined with the front casing 22 so that a gap corresponding to an outer inflow opening 23 to be described later in FIG. 3 is formed between the front casing 22 and the rear casing. Further, the rear casing 21 is outer guide means for guiding a gas moving at the outside of the casing 2 of FIG. 4 (including a gas moving along the installation surface 900) into the casing 2 and is inner guide means for guiding a gas moving at the inside of the casing 2 to a detection space 34 to be described later so that, specifically, a gas passage (a guide space) extending from the outer inflow opening 23 to the detection space 34 is formed between the detector body 4 and the rear casing.

The rear casing 21 of FIGS. 9 to 11 has, for example, a disk shape having a diameter larger than that of the attachment base 1 and widened in the direction along the XY plane. The rear casing is integrally formed of resin on the whole (including the "inner member of the rear casing 21" to be described later) and includes, more specifically, a rear casing side facing wall 211 and a rear casing side outer peripheral wall 212. The rear casing side facing wall 211 of FIG. 4 is to form a portion widened in the direction along the XY plane in the rear casing 21, that is, a portion facing the attachment base 1 and includes a guide recess portion 211*a* of FIG. 5. The guide recess portion 211*a* is guide means for guiding a gas to the detection space 34 of FIG. 4, but a detailed description thereof will be made below. Further, the rear casing side outer peripheral wall 212 is a first outer wall which forms a portion (an outer wall) extending in the height direction (the Z direction) of the rear casing 21 and extends toward the lower side (the −Z direction) while being widened outward from the outer edge portion of the rear casing side facing wall 211.

Further, the rear casing 21 of FIG. 9 includes, more specifically, component casings 611 to 616, short fins 621 to 623, long fins 631 and 632, prevention pieces 641 and 642, and ribs 651 to 659 (hereinafter, the "component casings 611 to 616, the short fins 621 to 623, the long fins 631 and 632, the prevention pieces 641 and 642, and the ribs 651 to 659" will be representatively referred to as the "inner member of the rear casing 21"). Additionally, as the configuration of the component casings 611 to 616, the component casings 611 to 616, the short fins 621 to 623, the long fin 632, and the ribs 651, 652, 654, 655, and 659 correspond to constituent accommodation means. Further, the component casing 616 corresponds to first constituent accommodation means and the component casings 611 to 614, the short fins 621 to 623, the long fin 632, and the ribs 651, 652, 654, and 659 correspond to second constituent accommodation means. Further, the ribs 651, 652, 654, and 659 correspond to combination walls. First, the component casings 611 to 616 of the "inner member of the rear casing 21" are accommodation means for accommodating components other than the detector cover 3, the detection space 34, the detector body 4, a light emitting portion 52, and a light receiving portion 53 of FIG. 4 corresponding to the detection means in the components (the constituents) constituting the alarm device 100 and, specifically, include an accommodation wall for defining the component accommodation space (the constituent accommodation space) which is a space for accommodating the component. Further, the component casings 611 to 616 (specifically, the accommodation walls of the component casings 611 to 616) are guide means for guiding a gas to the detection space 34 of FIG. 4 and are provided in consideration of the component arrangement space to serve as the guide means. Further, the short fins 621 to 623 are guide means for guiding a gas to the detection space 34 of FIG. 4 and are, specifically, protrusions, that is, second guide pieces extending from the component casings 611 to 613 of FIG. 9. Further, the long fins 631 and 632 are guide means for guiding a gas to the detection space 34 of FIG. 4 and, specifically, first guide pieces extending from ribs 657 and 659 to be described later in FIG. 9 (that is, the rear casing side outer peripheral wall 212). Here, the long fins are sufficiently longer than the short fin 621. Further, the prevention pieces 641 and 642 are guide means for guiding a gas to the detection space 34 of FIG. 4 and are prevention means for preventing dust included in a gas flowing into an inner space through slits 213*a* and 213*b* to be described later in FIG. 9 from intruding into the detection space 34 of FIG. 4. The ribs 651 to 659 of FIG. 9 are guide means for guiding a gas to the detection space 34, are reinforcement means for reinforcing the rear casing 21, and are positioning means for defining a relative positional relationship in the height direction (the Z direction) between the front casing 22 and the rear casing 21 of FIG. 6 (that is, the width of the outer inflow opening 23 of FIG. 3), specifically, inflow partition means for defining inner spaces of the outer inflow opening 23 and the casing 2 of FIGS. 3 and 4 and a gas passage extending from the outer inflow opening 23 to the detection space 34. For example, the ribs are provided in the rear casing side facing wall 211.

Additionally, the "width of the outer inflow opening 23" indicates a distance from the upper end of the outer inflow opening 23 to the lower end thereof. Further, in the following description, the ribs 651 to 659 will be appropriately and totally referred to as the "rib 65" when there is no need to distinguish the ribs from each other and the "inner member of the rear casing 21" will be described later in detail.

(Configuration-Casing-Front Casing)

Figure 12:
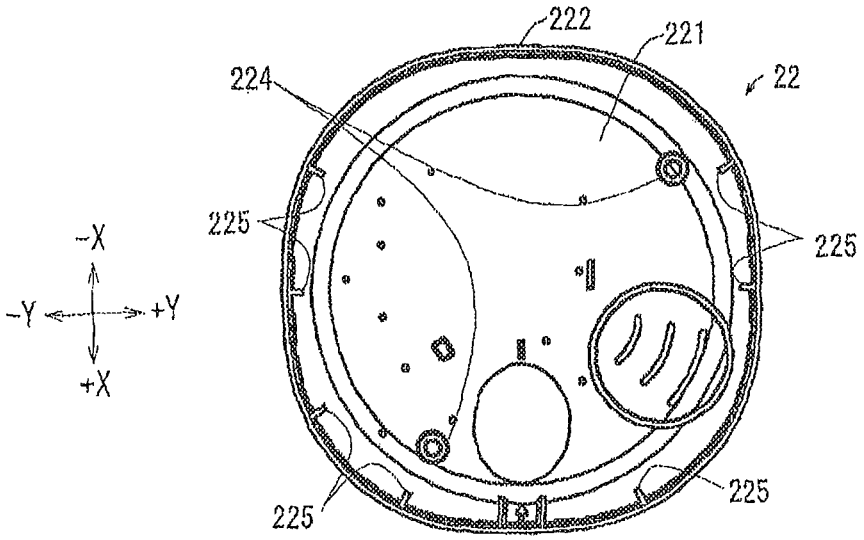
FIG. 12 is a plan view of a front casing.
Figure 13:
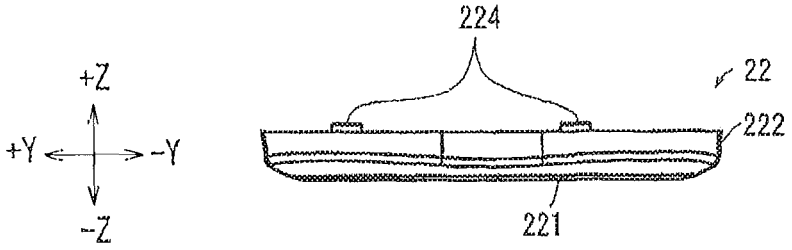
FIG. 13 is a front view of the front casing.

FIG. 12 is a plan view of the front casing and FIG. 13 is a front view of the front casing. As illustrated in FIG. 5, the front casing 22 in these drawings is second accommodation means (the other accommodation means) for accommodating the "accommodation object" from the opposite side to the attachment base 1 with the "accommodation object" interposed therebetween (that is, the lower side (the −Z direction)) and is, specifically, combined with the rear casing 21 so that a gap corresponding to the outer inflow opening 23 of FIG. 3 is formed between the rear casing 21 and the front casing. Here, the "outer inflow opening" 23 is inflow means for causing an external gas of the casing 2 to flow into the casing 2. Particularly, the outer flow opening is a first inflow opening which allows a gas moving along the installation surface 900 at the outside of the casing 2 to flow into the casing 2 and is a gap formed between the rear casing 21 and the front casing 22 of the casing 2 to extend in the direction along the XY plane. The width of the outer inflow opening 23 can be arbitrarily set in consideration of preventing the intrusion of dust, ambient light, and a user's finger and impression given to a user by the appearance of the alarm device 100. Here, a description will be made on the assumption that the width is set to, for example, 3 to 5 (mm). Further, the front casing 22 is outer guide means for guiding a gas moving at the outside of the casing 2 of FIG. 4 (including a gas moving along the installation surface 900) into the casing 2.

The front casing 22 of FIGS. 12 and 13 has, for example, a disk shape having a diameter larger than that of the rear casing 21 and widened in the direction along the XY plane and is integrally formed of resin on the whole. More specifically, the front casing includes a front casing side exposed wall 221 and a front casing side outer peripheral wall 222. First, the front casing side exposed wall 221 is used to form a portion widened in the direction along the XY plane in the front casing 22. That is, the front casing side exposed wall is exposed so as to be chiefly viewed by a user. Further, the front casing side outer peripheral wall 222 of FIG. 4 is a second outer wall which forms a portion (an outer wall) extending in the height direction (the Z direction) of the font casing 22 and extends upward (the +Z direction) while being widened outward from the outer edge portion of the front casing side exposed wall 221.

Further, the front casing 22 of FIG. 6 includes, more specifically, a push button 223, a threaded boss 224, and a support portion 225. First, the push button 223 is operation means for operating the alarm device 100 and is, specifically, used to press a switch 55 of the circuit unit 5 to be described later in FIG. 5 from the outside of the front casing 22. Further, the threaded boss 224 of FIG. 6 is positioning means for determining a relative positional relationship between the font casing 22 and the rear casing 21 in the height direction (the Z direction) (that is, the width of the outer inflow opening 23 of FIG. 3) and is fixing means for fixing the front casing 22 and the rear casing 21 of FIG. 6 to each other. Specifically, the threaded boss is provided at a surface at the upper side (the +Z direction) of the front casing side exposed wall 221 and has, for example, a pillar shape provided with a predetermined threaded hole and is formed upright in the height direction (the Z direction). Further, the support portion 225 is support means for supporting the detector body 4 and is, specifically, a plurality of protrusions provided at the side of the front casing side outer peripheral wall 222 in a surface at the upper side (the +Z direction) in the front casing side exposed wall 221.

(Configuration-Detector Cover)

Figure 14:
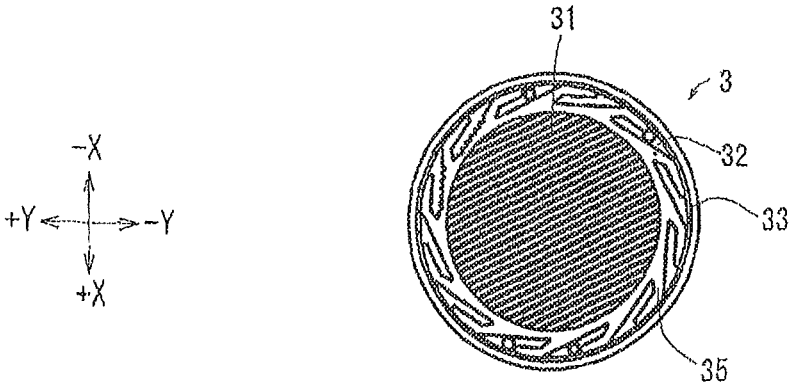
FIG. 14 is a bottom view of a detector cover.
Figure 15:
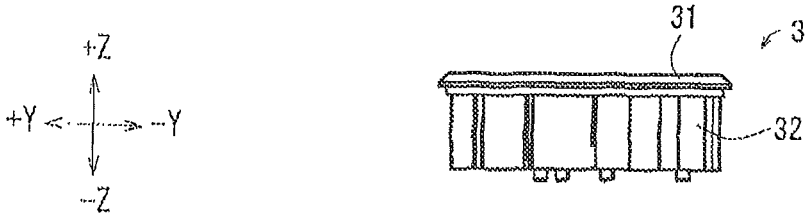
FIG. 15 is a front view of the detector cover in a state in which an insect screen is omitted.

Next, FIG. 14 is a bottom view of the detector cover and FIG. 15 is a front view of the detector cover in a state in which an insect screen is omitted. The detector cover 3 in these drawings is used to detect smoke by using scattered light and is a partition member for defining the detection space 34 of FIG. 4. Specifically, the detector cover is provided at the upper side (the +Z direction) of the detector body 4. Additionally, a part of the detector cover 3, the detection space 34, and the detector body 4, that is, the light emitting portion 52 and the light receiving portion 53 correspond to detection means. The detector cover 3 has, as illustrated in FIG. 5, a cylindrical shape in which one opening is blocked and, more specifically, includes a ceiling plate 31, a labyrinth 32, and an insect screen 33. Here, the "detection space" 34 of FIG. 4 is a space for detecting smoke. The ceiling plate 31 of FIG. 5 is used to cover the detection space 34. Specifically, the ceiling plate is formed in a disk shape having a diameter smaller than that of the casing 2 and the labyrinth 32 is integrally formed with a surface at the lower side (the −Z direction). The labyrinth 32 is a partition wall for defining the detection space 34. Specifically, the labyrinth is used to prevent the ambient light from entering the detection space 34 and is provided at a plurality of positions along the edge of the ceiling plate 31, for example, as illustrated in FIG. 14. With such a configuration, an inner inflow opening 35 is formed between the adjacent labyrinths 32. Here, the "inner inflow opening" 35 is a second inflow opening which allows a gas to flow into the detection space 34 and is formed as a gap between the labyrinth 32 and the inner inflow opening. Hereinafter, when there is a need to distinguish the plurality of inner inflow openings 35, the letters "a", "b", and the like will be given after the reference numeral "35" and, for example, the reference numeral "35a" and the reference numeral "35b" are used for description. When there is no need to distinguish the plurality of inner inflow openings 35, a description will be made by using the reference numeral "35" (the same also applies to the labyrinth 32). Returning to FIG. 5, the insect screen 33 is insect repellent means for allowing external air to enter the detection space 34 through a small hole of the insect screen 33 and preventing bugs from entering the detection space 34, is formed in an annular shape which surrounds the outer periphery of the labyrinth 32, and has a plurality of small holes formed at the side surface thereof to have a size in which bugs cannot easily enter.

(Configuration-Detector Body)

Figure 16:
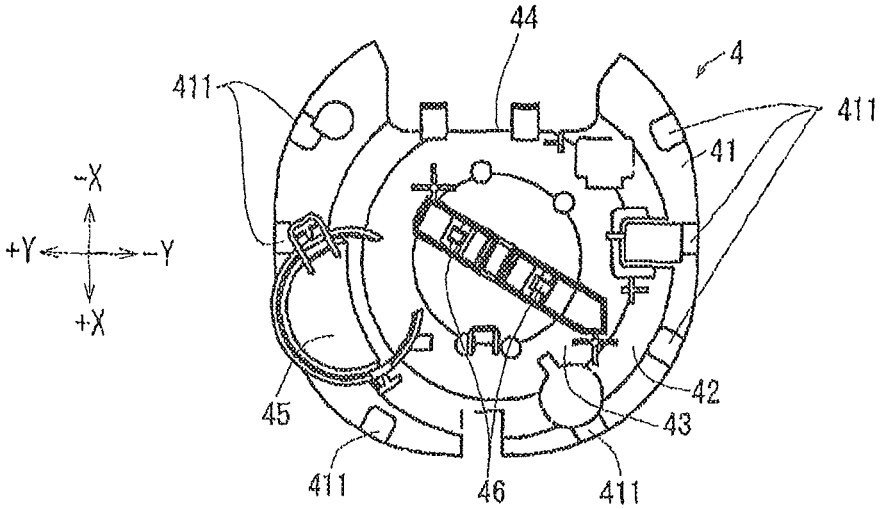
FIG. 16 is a bottom view of a detector body.
Figure 17:
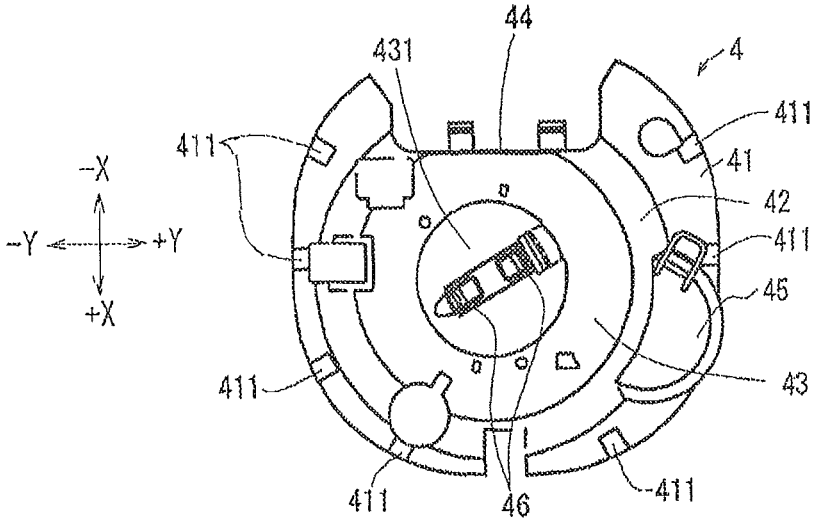
FIG. 17 is a plan view of the detector body.
Figure 18:
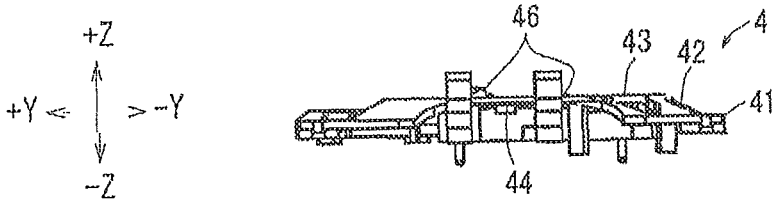
FIG. 18 is a front view of the detector body.

Next, FIG. 16 is a bottom view of the detector body, FIG. 17 is a plan view of the detector body, and FIG. 18 is a front view of the detector body. As illustrated in FIG. 4, the detector body 4 in these drawings is arrangement means for arranging the detector cover 3 and is partition means for defining the detection space 34 along with the detector cover 3. Specifically, the detector body forms a shield so that a gas flowing from the outer inflow opening 23 into the casing 2 does not flow between the detector body 4 and the font casing 22 and then forms a gas passage between the rear casing 21 and the detector body. For example, the detector body 4 is widened from the detector cover 3 of FIG. 4 to the outer inflow opening 23 in the direction along the XY plane. As illustrated in FIG. 6, the detector body has a disk shape which has a diameter larger than that of the ceiling plate 31 of the detector cover 3 and has a diameter slightly smaller than that of the front casing 22 and of which a part is notched. Further, the detector body has a shape in which a part of the inner portion is raised from the lower side (the −Z direction) toward the upper side (the +Z direction) and is integrally formed of resin on the whole. Additionally, the meaning that the "diameter is smaller than that of the front casing 22" is that the diameter of the detector body 4 is the "diameter" in which a detector body side end portion **400*a* contacts a front casing side end portion 222*a* at the inside thereof as illustrated in FIG. 4. Further, the "detector body side end portion" 400*a* indicates the outer edge in the detector body 4 and the edge at the side of the outer inflow opening 23**.

The detector body 4 of FIG. 6 includes, more specifically, a flange portion 41, a slope portion 42, a raised portion 43, a detector body notch portion 44, a speaker accommodation portion 45, and an element cover 46 of FIGS. 16 to 18. The flange portion 41 is a portion which is widened in the direction along the XY plane at the outside of the detector body 4 and includes a positioning recess portion 411. The positioning recess portion 411 is positioning means for positioning the rib 65 of the rear casing 21 with respect to the detector body 4. Specifically, the positioning recess portion is provided at a plurality of positions at the outer edge portion of the flange portion 41 and is recessed from the upper side (the +Z direction) toward the lower side (the −Z direction). Further, the slope portion 42 (the slope surface) is a portion which is continuous from the flange portion 41 and is inclined toward the upper side (the +Z direction) with respect to the flange portion 41 (the direction along the XY plane) in order to provide the detection space 34 of FIG. 4 at the upper side (the +Z direction) in relation to the outer inflow opening 23. Further, the raised portion 43 is a portion which is provided with the detector cover 3 and is a portion which is located at the upper side (the +Z direction) in relation to the flange portion 41, is continuous from the slope portion 42, and is widened in the direction along the XY plane. A surface at the upper side (the +Z direction) of the raised portion 43 is provided with an arrangement recess portion 431 of FIG. 6. The arrangement recess portion 431 is a portion in which the detector cover 3 is disposed. Specifically, the arrangement recess portion is a circular recess portion and is a recess portion having a diameter corresponding to the outer diameter of the detector cover 3. Further, the detector body notch portion 44 is a portion which is notched in a shape corresponding to the outer shape of the component casing 616 to provide the component casing 616 to be described later in the alarm device 100. Further, a speaker accommodation portion 45 is a portion which is raised from the lower side (the −Z direction) toward the upper side (the +Z direction) to accommodate a speaker (not illustrated) between the detector body 4 and the front casing 22 and to correspond to the outer shape of the speaker accommodated therein. Further, the element cover 46 is used to prevent dust from being accumulated on the light emitting portion 52 and the light receiving portion 53 while covering the light emitting portion 52 and the light receiving portion 53 to be described later in the circuit unit 5 from the upper side (the +Z direction), is formed at the arrangement recess portion 431 of the raised portion 43, and has an optical path hole for forming an optical path in the detection space 34 of FIG. 4 with respect to the light emitting portion 52 and the light receiving portion 53 to be described later in the circuit unit 5.

(Configuration-Circuit Unit)

Figure 19:
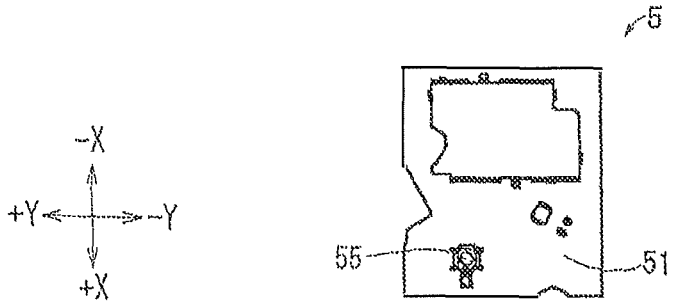
FIG. 19 is a bottom view of a circuit unit.
Figure 20:
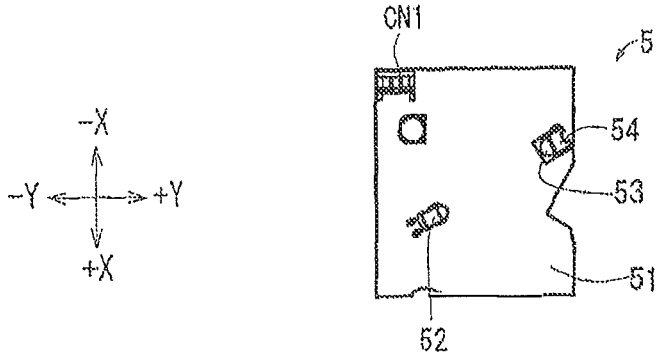
FIG. 20 is a plan view of the circuit unit.
Figure 21:
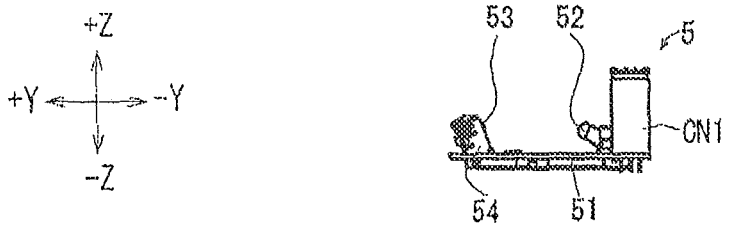
FIG. 21 is a front view of the circuit unit.

Next, FIG. 19 is a bottom view of the circuit unit, FIG. 20 is a plan view of the circuit unit, and FIG. 21 is a front view of the circuit unit. The circuit unit 5 in these drawings is circuit means forming an electric circuit for generating an alarm and includes, more specifically, a circuit board 51, the light emitting portion 52, the light receiving portion 53, a shield 54, the switch 55, and a power connector CN1. The circuit board 51 is mounting means for mounting the elements of the alarm device 100 thereon. Specifically, a through-hole and an element surrounding the through-hole are provided at a predetermined position so that elements are mounted on the mounting surface (hereinafter, the upper mounting surface) at the upper side (the +Z direction) or the mounting surface (hereinafter, the lower mounting surface) at the lower side (the −Z direction) by soldering or the like. The light emitting portion 52 is light emitting means for emitting light Specifically, as illustrated in FIG. 4, the light emitting portion is an element, for example, a light emitting diode mounted on the upper mounting surface of the circuit board 51 so that light is emitted toward the detection space 34 at the upper side (the +Z direction) in relation to the light emitting portion 52. The light receiving portion 53 is light receiving means for receiving the scattered light generated when the light emitted from the light emitting portion 52 is scattered by particles of smoke. Specifically, the light receiving portion is an element, for example, a photo diode which is mounted on the upper mounting surface of the circuit board 51 so that the light emitted from the detection space 34 provided at the upper side (the +Z direction) in relation to the light receiving portion 53 is received. The shield 54 of FIG. 21 is shield means for electromagnetically shielding the light receiving portion 53 and is support means for supporting the light receiving portion 53 by the circuit board 51. Specifically, the shield is a conductive element mounted on the upper mounting surface of the circuit board 51 and is formed of; for example, metal. The switch 55 of FIG. 19 is operation means for operating the alarm device 100. Specifically, the switch is an element mounted on the lower mounting surface of the circuit board 51 and is, for example, a push switch. The power connector CN1 of FIG. 20 is supply means for supplying electric power to the alarm device 100. Specifically, the power connector is used to supply electric power from a battery (not illustrated) corresponding to a power supply and is mounted on the upper mounting surface of the circuit board 51.

(Configuration-Detail)

Next, a configuration for allowing a gas to flow into the alarm device 100 of FIG. 1 will be described in more detail. Specifically, detailed configurations of the rear casing side outer peripheral wall 212 and the front casing side outer peripheral wall 222 of FIG. 4, the slits 213*a* and 213*b* of FIG. 1, the "inner member of the rear casing 21" and the detection space 34 of FIG. 9, and the guide recess portion 211*a* of FIG. 5 will be described.

(Configuration-Detail-Rear Casing Side Opposite Wall and Rear Casing Side Outer Peripheral Wall)

First, the rear casing side facing wall 211 of FIG. 4 is used to form a portion widened in the direction along the XY plane of the rear casing 21 as described above. More specifically, the rear casing side facing wall 211 is formed to have substantially the same diameter as that of the attachment base 1. Further, as described above, the rear casing side outer peripheral wall 212 of FIG. 4 is a first outer wall which forms a portion (an outer wall) extending in the height direction (the Z direction) of the rear casing 21 and extends toward the lower side (the −Z direction) while being widened outward from the outer edge portion of the rear casing side facing wall 211. More specifically, the rear casing side outer peripheral wall 212 is inclined inward as it goes toward the rear casing side facing wall 211 (that is, toward the upper side (the +Z direction)). With such a configuration, an outer stagnation point P1 is formed among the rear casing side outer peripheral wall 212, the attachment base 1, and the installation surface 900. In this way, a configuration in which the "rear casing side outer peripheral wall 212 is inclined" corresponds to the first outer guide means. Here, the "outer stagnation point" P1 is a space in which the gas is difficult to move and accumulate and is a space which guides a "gas other than the stagnating gas" toward a direction other than the outer stagnation point P1 by preventing a "gas other than the stagnating gas" (that is, the moving gas) from entering the space. Specifically, the outer stagnation point is a space which is formed based on the shape of the alarm device 100 in consideration of the air flow toward the alarm device 100 and is a space which guides the gas to the outer inflow opening 23. With such a configuration, it is possible to guide the gas moving along the installation surface 900 at the outside of the casing 2 to the outer inflow opening 23.

(Configuration-Detail-Front Casing Side Outer Peripheral Wall)

Further, as described above, the front casing side outer peripheral wall 222 of FIG. 4 is a second outer wall which forms a portion (an outer wall) extending in the height direction (the Z direction) of the front casing 22 and extends toward the upper side (the +Z direction) while being widened outward from the outer edge portion of the front casing side exposed wall 221. More specifically, the front casing side outer peripheral wall 222 is gently inclined outward as it goes toward the rear casing side outer peripheral wall 212 (that is, toward the upper side (the +Z direction)). Then, the front casing side end portion 222*a* of the front casing side outer peripheral wall 222 is disposed at the outside in relation to the rear casing side end portion 212*a* of the rear casing side outer peripheral wall 212. In this way, a configuration in which the "front casing side end portion 222*a* is disposed at the outside in relation to the rear casing side end portion 212*a*" corresponds to the second outer guide means. Additionally, the "front casing side end portion" 222*a* indicates an edge located at the outside of the front casing 22 and located at the side of the outer inflow opening 23. Further, the "rear casing side end portion" 212*a* indicates an edge located at the outside of the rear casing 21 and an edge located at the side of the outer inflow opening 23.

Here, the positional relationship of the front casing side end portion 222*a* with respect to the rear casing side end portion 212*a* can be arbitrarily set in consideration of the guiding performance for guiding the external gas to the inside of the casing 2 and the visual impression given to the user of the alarm device 100 as long as the front casing side end portion 222*a* is disposed at the outside in relation to the rear casing side end portion 212*a* as described above. However, here, for example, the positional relationship is set such that the front casing side end portion 222*a* is disposed at the outside in relation to the rear casing side end portion 212*a* by the thickness of the front casing 22. With such a configuration, since the gas flowing from the upper side (the +Z direction) toward the lower side (the −Z direction) along the rear casing side outer peripheral wall 212 contacts the front casing side end portion 222*a* to be guided toward the outer inflow opening 23, the gas can be guided to the outer inflow opening 23.

(Configuration-Detail-Slit)

Further, the slits 213*a* and 213*b* of FIG. 1 are flowing means for allowing the gas to flow thereinto along with the outer inflow opening 23. Specifically, the slits are provided in the rear casing side outer peripheral wall 212 of FIG. 11. The slits 213*a* and 213*b* can have an arbitrary configuration in consideration of the guiding performance for guiding the external gas into the casing 2 of FIG. 1 and the strength of the casing 2. However, here, for example, the slits have the following configuration from the viewpoint of improving the guiding performance in the periphery of the portion (that is, the component casing 616) without the outer inflow opening 23 of the casing 2. Specifically, the slits 213*a* and 213*b* are provided at both sides of the component casing 616 (specifically, both sides of the outer accommodation wall 616*a* of the component casing 616) to communicate with the outer inflow opening 23 while being orthogonal to the outer inflow opening 23. With such a configuration, the gas can flow into the alarm device 100 from all directions based on the alarm device 100.

(Configuration-Detail-Inner Member of Rear Casing)

Figure 22:
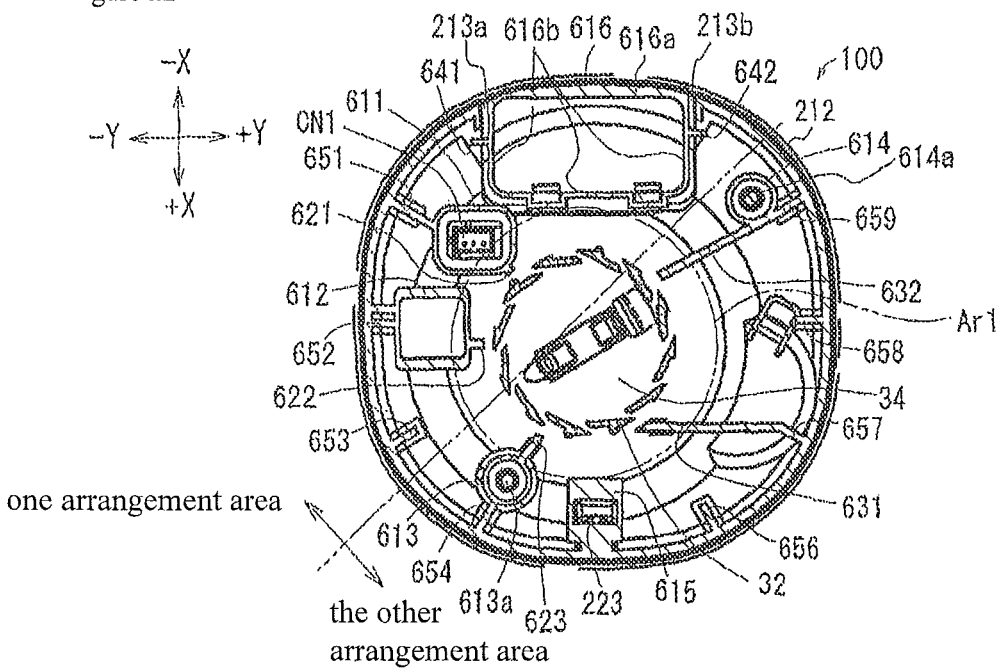
FIG. 22 is a cross-sectional view taken along the line B-B of FIG. 3.

Next, the inner members (that is, the component casings 611 to 616, the short fins 621 to 623, the long fins 631 and 632, the prevention pieces 641 and 642, and the ribs 651 to 659) of the rear casing 21 illustrated in FIG. 9 will be described in detail. FIG. 22 is a cross-sectional view taken along the line B-B of FIG. 3. In FIG. 22, the lines of the insect screen 33 and the arrangement recess portion 431 of FIG. 6 are omitted for convenience of description.

(Configuration-Detail-Inner Member of Rear Casing-Component Casing)

As described above, the component casings 611 to 616 of FIG. 22 are accommodation means (constituent accommodation means) for accommodating components other than the detector cover 3, the detection space 34, the detector body 4, the light emitting portion 52, and the light receiving portion 53 of FIG. 4 corresponding to the detection means among the components (the constituents) constituting the alarm device 100 and are guide means for guiding the gas to the detection space 34. Additionally, the component casings 613 and 614 are also positioning means for determining the relative positional relationship between the front casing 22 and the rear casing 21 in the height direction (the Z direction) (that is, the width of the outer inflow opening 23 of FIG. 3) by the contact with the threaded boss 224 of FIG. 6. Returning to FIG. 22, specifically, the component casing 611 is used to accommodate the power connector CN1 corresponding to an electric constituent, the component casing 612 is used to accommodate a transfer connector (not illustrated) corresponding to an electric constituent, the component casings 613 and 614 are used to accommodate the fixing screws 613*a* and 614*a* corresponding to a mechanical constituent instead of the electric constituent, the component casing 615 is used to accommodate a part of the push button 223 of FIG. 5 corresponding to a mechanical constituent instead of an electric constituent, and the component casing 616 is constituent accommodation means for accommodating a battery (not illustrated) corresponding to an electric constituent and corresponding to a power supply of the alarm device 100. Here, the "transfer connector" is a connector for outputting a transfer signal indicating a state where smoke is detected to the outside and can be provided in response to the necessity of the transfer signal. However, here, for example, a case without the transfer connector will be described. Further, the "fixing screws" 613*a* and 614*a* are fixing screws for connecting the rear casing 21 and the front casing 22 of FIG. 5 to each other. Then, these component casings 611 to 616 can have an arbitrary configuration in consideration of the position, the size, and the shape of the component. However, here, as illustrated in FIG. 22, the inflow gas can be guided to the detection space 34 after the gas is allowed to appropriately flow into the alarm device 100 from all directions based on the alarm device 100.

For example, the component casing 616 of FIG. 22 is attached to the end at the side of the attachment hook 11 (that is, the −X direction) in consideration of the center of gravity of the alarm device 100 when the alarm device 100 is attached to the "wall installation surface (not illustrated)" by using the attachment hook 11 of FIG. 7. Then, the outer accommodation wall 616*a* (the first portion) of the component casing 616 forms a part of the outer wall of the casing 2 (specifically, the rear casing side outer peripheral wall 212) and the inner accommodation wall 616*b* (the second portion) of the component casing 616 forms the gas passage. Further, the component casing 616 is formed in the largest rectangular shape among the component casings 611 to 616. Further, the height of the component casing 616 in the Z direction is set to the height corresponding to the shape of the detector body 4 so that at least a part (for example, an end portion or a surface) of the component casing 616 contacts (or approaches) the detector body 4 and defines the gas passage along with the detector body 4 at the time of assembling the alarm device 100 of FIG. 5 (additionally, the height in the Z direction other than the "component casing 616" in the "inner member of the rear casing 21" is also set similarly to the component casing 616). Next, the component casing 611 is provided at a position in the vicinity of the component casing 616 and a position separated from the rear casing side facing wall 211 in consideration of the shape and the position of the component accommodated in the component casing 611 and has a rectangular shape. Further, the component casing is combined with the rear casing side outer peripheral wall 212 through the rib 651. Next, the component casing 612 is provided at a position in the vicinity of the component casing 611 and a position separated from the rear casing side facing wall 211 in consideration of the shape and the position of the component accommodated in the component casing 612 and has a rectangular shape. Further, the component casing is combined with the rear casing side outer peripheral wall 212 through the rib 652. Next, the component casings 613 and 614 are provided at positions opposite to each other with the detection space 34 interposed therebetween and positions separated from the rear casing side facing wall 211 in consideration of the shape and the position of the components accommodated in the component casings 613 and 614 and have a circular shape. Further, the component casings are combined with the rear casing side outer peripheral wall 212 through the ribs 654 and 659. Next, the component casing 615 is provided at a position opposite to the component casing 616 with the detection space 34 interposed therebetween and a position contacting the rear casing side facing wall 211 in consideration of the shape and the position of the component accommodated in the component casing 615 and has a rectangular shape. With such a configuration, the inflow gas can be guided to the detection space 34. Further, with such a configuration, the inside of the casing 2 is divided into one arrangement area (the left area of the drawing based on the boundary of the two-dotted chain line of FIG. 22) (the electric constituent arrangement area) in which the component casings 611, 612, and 616 accommodating the electric component (the electric constituent) are provided and the component casings are relatively densely provided and the other arrangement area (the right area of the drawing based on the boundary of the two-dotted chain line of FIG. 22) (the electric constituent non-arrangement area) in which the component casings 611, 612, and 616 are not provided and the component casings are not densely arranged.

(Configuration-Detail-Inner Member of Rear Casing-Short Fin)

Figure 23:
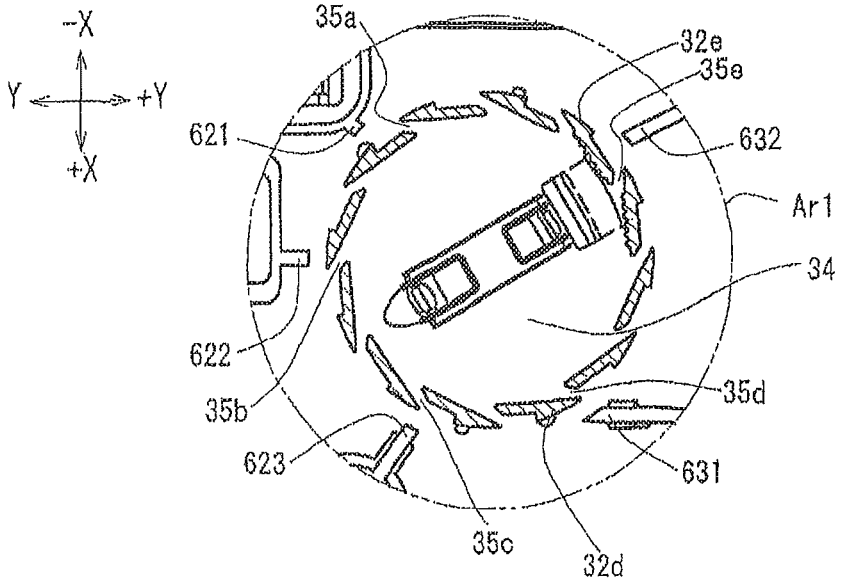
FIG. 23 is an enlarged view of an area Ar1 of FIG. 22.

As described above, the short fins 621 to 623 are guide means for guiding the gas to the detection space 34. Specifically, the short fins are protrusions which extend from the component casings 611 to 623 toward the detection space 34 and are second guide pieces. Such short fins 621 to 623 can have an arbitrary configuration in consideration of the air flow caused by the configuration of the "inner member of the rear casing 21". However, here, as illustrated in FIG. 22, the inflow gas can be guided to the detection space 34 after the gas is allowed to appropriately flow into the alarm device 100 from all directions based on the alarm device 100. FIG. 23 is an enlarged view of the area Ar1 of FIG. 22. For example, in the short fins 621 to 623 of FIG. 23, the front ends of the short fins 621 to 623 at the side of the detection space 34 are not in contact with the labyrinth 32 and the front ends are disposed in the vicinity of the inner inflow openings 35*a* to 35*c*. With such a configuration, the inflow gas can be guided to the detection space 34.

(Configuration-Detail-Inner Member of Rear Casing-Long Fin)

As described above, the long fins 631 and 632 of FIG. 22 are guide means for guiding the gas to the detection space 34. Specifically, the long fins are protrusions (first guide pieces) extending from the ribs 657 and 659 (that is, the rear casing side outer peripheral wall 212) are sufficiently longer than the short fin 621. Such long fins 631 and 632 can have an arbitrary configuration in consideration of the air flow caused by the configuration of the "inner member of the rear casing 21". However, here, as illustrated in FIG. 22, the inflow gas can be guided to the detection space 34 after the gas is allowed to appropriately flow into the alarm device 100 from all directions based on the alarm device 100. For example, the long fins 631 and 632 are disposed in the "other arrangement area". Further, the front ends of the long fins 631 and 632 of FIG. 23 at the side of the detection space 34 are not in contact with the labyrinth 32 and the front ends are disposed in the vicinity of the inner inflow openings 35*d* and 35*e*. Further, the long fin 631 straightly extends in the same direction as the extension direction of the labyrinth 32*d*. That is, the long fins extend on the extension line of the labyrinth 32*d*. Further, the long fin 632 straightly extends in a direction orthogonal to the extension direction of the labyrinth 32*e*. With such a configuration, the inflow gas can be guided to the detection space 34.

(Configuration-Detail-Inner Member of Rear Casing-Prevention Piece)

As described above, the prevention pieces 641 and 642 of FIG. 22 are guide means for guiding the gas to the detection space 34, are prevention means for preventing dust included in the gas flowing thereinto through the slits 213*a* and 213*b* from entering the detection space 34, and guide means for guiding the gas to the detection space 34. Such prevention pieces 641 and 642 can have an arbitrary configuration in consideration of the air flow caused by the configurations of the "inner member of the rear casing 21" and the slits 213*a* and 213*b*. However, here, as illustrated in FIG. 22, the inflow gas can be guided to the detection space 34 and the entrance of dust can be prevented after the gas in the periphery of the component casing 616 is allowed to appropriately flow into the alarm device 100. For example, the prevention pieces 641 and 642 are provided at positions facing the slits 213*a* and 213*b*. Specifically, the prevention pieces protrude from a portion extending toward the detection space 34 in the inner accommodation wall 616*b* of the component casing 616 in a direction orthogonal to the extension direction of the inner accommodation wall 616*b*. With such a configuration, the inflow gas can be guided to the detection space 34 while the entrance of dust into the detection space 34 is prevented.

(Configuration-Detail-Inner Member of Rear Casing-Rib)

As described above, the ribs 651 to 659 of FIG. 22 (additionally, the rib 655, see FIG. 9) are guide means for guiding the gas to the detection space 34 and are reinforcement means for reinforcing the rear casing 21. Further, the ribs 651 to 659 are fixing and supporting means for fixing and supporting the front casing 22 to the rear casing 21 of FIG. 6 and are positioning means for determining the relative positional relationship between the front casing 22 and the rear casing 21 in the height direction (the Z direction) (that is, the width of the outer inflow opening 23 of FIG. 3). Further, the ribs 651 to 659 are inflow partition means for defining the outer inflow opening 23 and the gas passage extending from the outer inflow opening 23 to the detection space 34 of FIG. 4. Here, the meaning that the "front casing 22 is fixed and supported to the rear casing 21" indicates that the rear casing 21 and the front casing 22 are fixed to each other so that the relative positions of the rear casing 21 and the front casing 22 do not deviate from each other. Specifically, the rear casing 21 and the front casing 22 are fixed to each other so as to prevent the relative positional deviation between the rear casing 21 and the front casing 22 at least in the height direction (the Z direction) or the direction along the installation surface 900 (the direction along the XY plane). Then, the ribs 651 to 659 of FIG. 22 can have an arbitrary configuration in consideration of the air flow caused by the configuration of the "inner member of the rear casing 21", the strength of the rear casing 21, and the width of the outer inflow opening 23. However, here, as illustrated in FIG. 22, the inflow gas can be guided to the detection space 34, the strength of the rear casing 21 can be sufficiently ensured, and the width of the outer inflow opening 23 of FIG. 3 can be set to "3 to 5 (mm)" after the gas is allowed to appropriately flow into the alarm device 100 from all directions based on the alarm device 100. For example, the ribs 651 to 659 extend from the rear casing side outer peripheral wall 212 to the rear casing side facing wall 211 and extend by a predetermined length (for example, 1 to 2 (cm)) toward the inside of the rear casing 21 from the rear casing side outer peripheral wall 212. In particular, the ribs 651, 652, 654, and 659 of the ribs 651 to 659 extend until the end portions of the ribs 651, 652, 654, and 659 at the inside (at the side of the detection space 34) reach the component casings 611 to 614 and are combined with the component casings 611 to 614. With such a configuration, the gas flowing from the outer inflow opening 23 of FIG. 4 into the casing 2 can be reliably guided to the detection space 34. Further, for example, the rib 65 (which is the representative name of the ribs 651 to 659) of FIG. 6 protrudes toward the lower side (the −Z direction) (that is, toward the front casing 22) in relation to the rear casing side outer peripheral wall 212 so as to contact the positioning recess portion 411 of the flange portion 41 of the detector body 4 when assembling the alarm device 100. With such a configuration, the inflow gas can be guided to the detection space 34 after the detector body 4 is reliably fixed to the alarm device 100 while the rear casing 21 is reinforced.

(Configuration-Detail-Detection Space)

Figure 24:
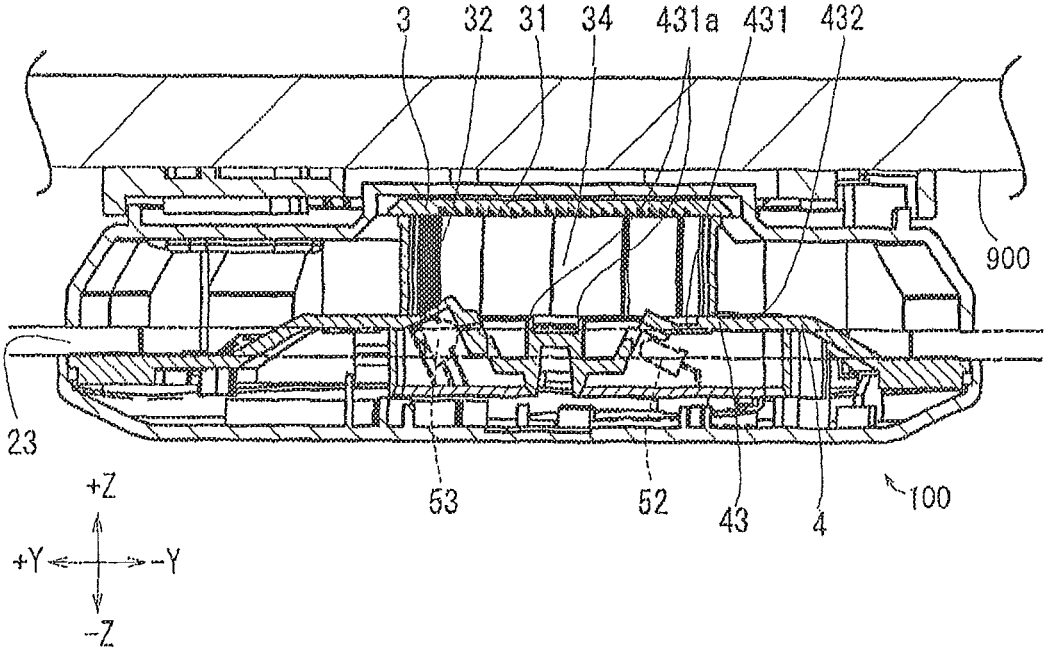
FIG. 24 is an enlarged view of FIG. 4.

FIG. 24 is an enlarged view of FIG. 4. As described above, the detection space 34 of FIGS. 4 and 24 is a space for detecting smoke and is a space in which smoke to be detected by the alarm device 100 exists. Specifically, the detection space is a space which is defined by the detector cover 3 and the detector body 4 inside the casing 2. More specifically, since the detection space 34 is formed by disposing the detector cover 3 in the raised portion 43 of the detector body 4 of FIG. 6, the detection space is formed so that the entire detection space 34 is provided at the upper side (the +Z direction) in relation to the outer inflow opening 23 (that is, the entire portion of the detection space 34 is provided at the upper side (the +Z direction) in relation to the end portion at the most upper side (the +Z direction) of the outer inflow opening 23) while any portion of the detection space 34 is not located at the outer inflow opening 23. With such a configuration, the inflow gas can be guided to the detection space 34 while the entrance of dust into the detection space 34 is prevented. That is, it is possible to improve smoke detection accuracy of the alarm device 100 by preventing dust and disturbing light from entering the detection space 34. Further, the detection space 34 is a space existing at the further upper side (the +Z direction) in relation to the end portion at the upper side (the +Z direction) of the light shielding plate 431*a* of the detector body 4 in a space surrounded by the ceiling plate 31 and the labyrinth 32 of the detector cover 3 and the detector body 4. Here, the "light shielding plate" 431*a* is light shielding means for shielding light. Specifically, the light shielding means is used to shield light emitted from the light emitting portion 52 so that the light emitted from the light emitting portion 52 is not directly incident to the light receiving portion 53 and protrudes toward, for example, the upper side (the +Z direction). More specifically, the light shielding plate 431*a* is formed so that, for example, the height of the end portion at the upper side (the +Z direction) of the light shielding plate 431*a* is substantially the same as the height of the surface at the upper side (the +Z direction) of the plane portion 432 corresponding to the portion other than the arrangement recess portion 431 of the raised portion 43 of the detector body 4. Then, since the detection space 34 is formed by disposing the detector cover 3 with respect to the raised portion 43 of the detector body 4 of FIG. 6, the entire detection space 34 is provided at the upper side (the +Z direction) in relation to the outer inflow opening 23 (that is, the entire portion of the detection space 34 is provided at the further upper side (the +Z direction) in relation to the upper two-dotted chain line among two two-dotted chain lines extending in the Y direction and depicted for convenience of description in FIG. 23 to show the end portion at the most upper side (the +Z direction) of the outer inflow opening 23) while any portion of the detection space 34 of FIG. 23 is not located at the outer inflow opening 23. With such a configuration, since it is possible to promptly and reliably detect smoke while preventing the occurrence of the erroneous detection by guiding the inflow gas to the detection space 34 while preventing the disturbance of the detection space 34, it is possible to improve smoke detection accuracy. Here, the "disturbance" is an object other than the detection target material (in the embodiment, smoke). Specifically, the disturbance is an object that causes the erroneous detection in the alarm device 100 and is, for example, dust, water vapor, or disturbing light. Further, the "erroneous detection" means that the detection target material is detected by mistake. Specifically, the erroneous detection means that disturbance is detected as the detection target material (in the embodiment, smoke). For example, this is a phenomenon which may be generated when a relatively large amount of disturbance enters the detection space 34 of FIG. 23.

(Configuration-Detail-Recess Portion of Rear Casing)

Figure 25:
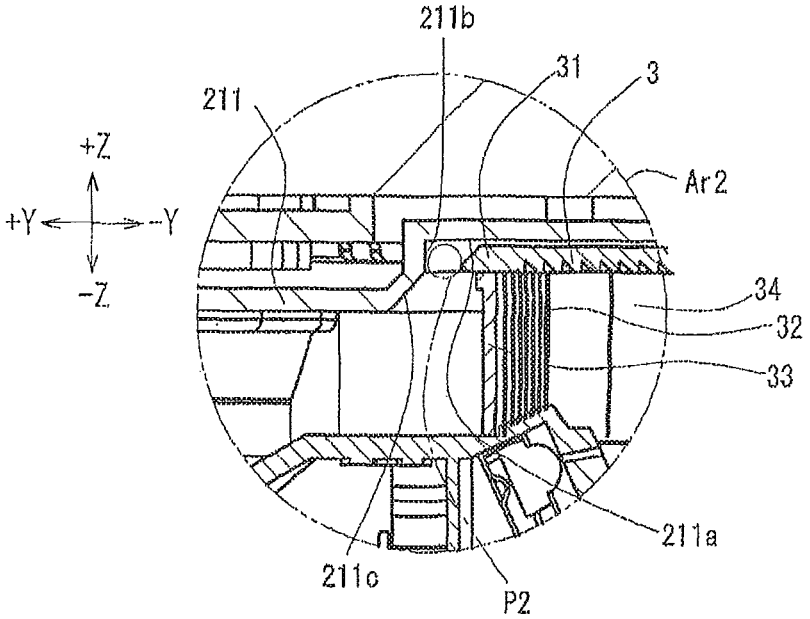
FIG. 25 is an enlarged view of an area Ar2 of FIG. 4.

Next, the guide recess portion 211*a* of the rear casing 21 illustrated in FIG. 5 will be described in detail. FIG. 25 is an enlarged view of the area Ar2 of FIG. 4. As described above, the guide recess portion 211*a* of FIG. 5 is guide means for guiding the gas to the detection space 34 of FIG. 4 and is positioning means for positioning the detector cover 3. Specifically, the guide recess portion is a portion which is recessed toward the upper side (the +Z direction) from the lower side (the −Z direction) in the surface at the lower side (the −Z direction) of the rear casing side facing wall 211, is a portion which has a diameter larger than that of the ceiling plate 31 of the detector cover 3 of FIG. 25, and is a portion which has facing surfaces 211*b* and 211*c*. The facing surfaces 211*b* and 211*c* are inner guide means for guiding the gas to the detection space 34. Specifically, the facing surfaces are surfaces which face at least a part of the detector cover 3 (for example, the ceiling plate 31 and the like) and are portions which are separated from the detector cover 3 in the direction along the XY plane not to contact the detector cover 3. The facing surface 211*b* extends from, specifically, the surface at the lower side (the −Z direction) of the guide recess portion 211*a* toward the lower side (the −Z direction) in the height direction (the Z direction). Further, the facing surface 211*c* is continuous, specifically, from the facing surface 211*b* and is inclined with respect to the insect screen 33 and the labyrinth 32 outward as it goes away from the attachment base 1 (that is, toward the lower side (the −Z direction)). With such a configuration, since particularly the facing surface 211*b* is separated from the detector cover 3, the inner stagnation point P2 is formed between the facing surface 211*b* and a part of the detector cover 3 (for example, the ceiling plate 31) so that the gas moving inside the casing 2 can be guided to the detection space 34. Here, the "inner stagnation point" P2 is a space in which the gas is difficult to move and accumulate and is a space which guides the "gas other than the stagnating gas" in a direction other than the inner stagnation point P2 by preventing the "gas other than the stagnating gas" (that is, the moving gas) from entering the space. Specifically, the gas is a space which is formed based on the inner shape of the casing 2 in consideration of the air flow inside the casing 2 and is a space which guides the gas to the detection space 34.

(Assembly Method)

Next, a method of assembling the alarm device 100 will be described. First, in FIG. 6, the elements are mounted on the circuit board 51 of the circuit unit 5. Specifically, the elements are mounted by using, for example, solder in a state where the circuit board 51 is disposed and fixed to a predetermined jig.

Next, the detector cover 3 is disposed with respect to the detector body 4. Specifically, the detector cover 3 is disposed at the arrangement recess portion 431.

Next, the push button 223 and the circuit board 51 are disposed in the front casing 22 and further the detector body 4 having the detector cover 3 disposed thereon is disposed in the front casing 22. Specifically, the detector body 4 is disposed so that the light emitting portion 52 and the light receiving portion 53 of the circuit board 51 are appropriately covered by the element cover 46 of the detector body 4 and the positioning recess portion 411 of the detector body 4 is supported (placed) on the support portion 225 of the front casing 22. In this case, as illustrated in FIG. 4, the light emitting portion 52 is configured to emit light toward the ceiling plate 31 (that is, the upper side (the +Z direction)) and the light receiving portion 53 is configured to receive scattered light from the ceiling plate 31.

Next, the rear casing 21 is disposed in the front casing 22. Specifically, the rear casing is disposed so that the component casings 613 and 614 of the rear casing 21 of FIG. 5 are brought into contact with the threaded boss 224 of the front casing 22 of FIG. 6 through the insertion hole 47 of the detector body 4 while facing the threaded boss and the rib 65 of the rear casing 21 is provided inside the positioning recess portion 411 of the detector body 4.

Next, the rear casing 21 is fixed and combined with the front casing 22. Specifically, the fixing screws 613*a* and 614*a* are inserted through the insertion holes 613*b* and 614*b* communicating with the component casings 613 and 614 of the rear casing 21 and the component casings 613 and 614 of FIG. 5 and the threaded boss 224 of FIG. 6 are fixed to each other by threading using the inserted fixing screws 613*a* and 614*a*. In this case, the positioning recess portion 411 of the detector body 4 is fixed to be sandwiched between the support portion 225 of the front casing 22 and the rib 65 of the rear casing 21. Further, the rear casing 21 and the front casing 22 are fixed and supported to each other by the rib 65 (that is, the front casing 22 is fixed and supported to the rear casing 21). Further, as illustrated in FIG. 3, the outer inflow opening 23 is formed. In this way, the assembly of the alarm device 100 ends. Additionally, the rear casing 21 and the front casing 22 of FIG. 6 are fixed and supported by the rib 65. Specifically, as shown below, the rear casing 21 and the front casing 22 of FIG. 6 are indirectly fixed and supported by the rib 65 in the height direction (the Z direction) of FIG. 4 and the direction along the installation surface 900 (the direction along the XY plane). First, more specifically, when the fixing screws 613*a* and 614*a* are threaded into the threaded boss 224 in the height direction (the Z direction) as described above, the rib 65 of the rear casing 21 is pressed against the front casing 22 through the detector body 4 (specifically, the positioning recess portion 411 of the detector body 4). For this reason, the relative positions of the rear casing 21 and the front casing 22 in the height direction (the Z direction) are fixed so that the rear casing 21 and the front casing 22 are indirectly supported in the height direction (the Z direction). Further, more specifically, when the fixing screws 613*a* and 614*a* are threaded into the threaded boss 224 in the direction along the XY plane as described above, the fixing screws 613*a* and 614*a* are inserted through the insertion hole 47 of the detector body 4 and thus the detector body 4 is fixed to the front casing 22 in the direction along the XY plane. Then, since the rib 65 of the rear casing 21 is provided inside the positioning recess portion 411 of the fixed detector body 4, the rib 65 is caught by the end of the positioning recess portion 411 in the direction along the XY plane so that the separation from the positioning recess portion 411 is prevented. For this reason, the relative positions of the rear casing 21 and the front casing 22 in the direction along the XY plane are fixed and the rear casing 21 and the front casing 22 are indirectly fixed and supported in the direction along the XY plane.

(Installation Method)

Next, a method of installing the alarm device 100 will be described. First, the attachment base 1 is attached to the installation surface 900 of FIG. 4. Specifically, the attachment base 1 is attached in such a manner that the attachment screw is threaded into the installation surface 900 through the threaded hole 121 of FIG. 6 while the installation surface side facing surface 12B faces the installation surface 900.

Next, the casing 2 of the alarm device 100 of FIG. 4 assembled according to the above-described "assembly method" is attached to the attachment base 1. Specifically, the casing 2 is attached in such a manner that the engagement portion 214 of the rear casing 21 of FIG. 6 engages with the engagement portion 122 of the attachment base 1 of FIG. 5. In this way, the installation of the alarm device 100 ends.

(Guide of Gas)

Figure 26:
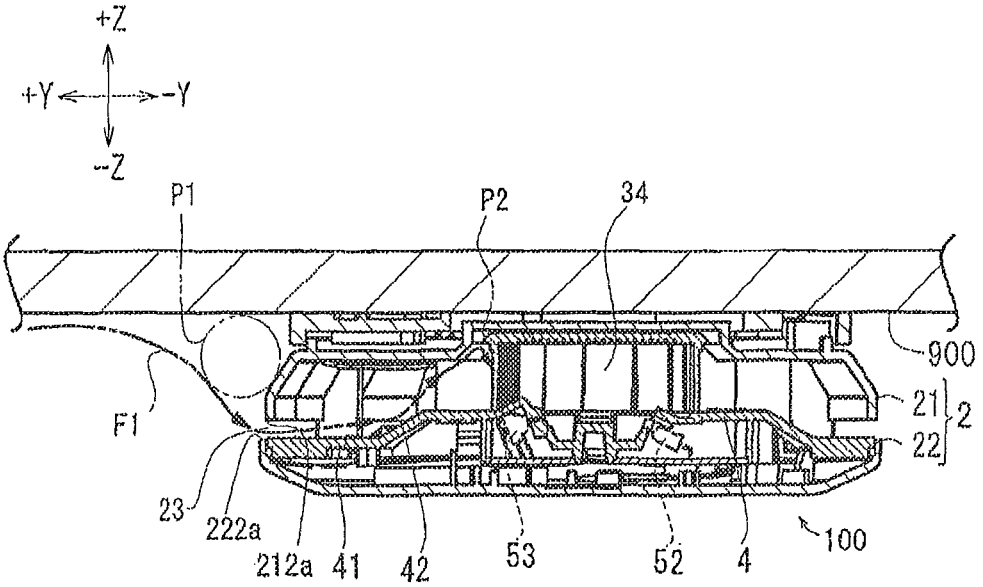
FIG. 26 is a diagram illustrating an air flow in FIG. 4.
Figure 27:
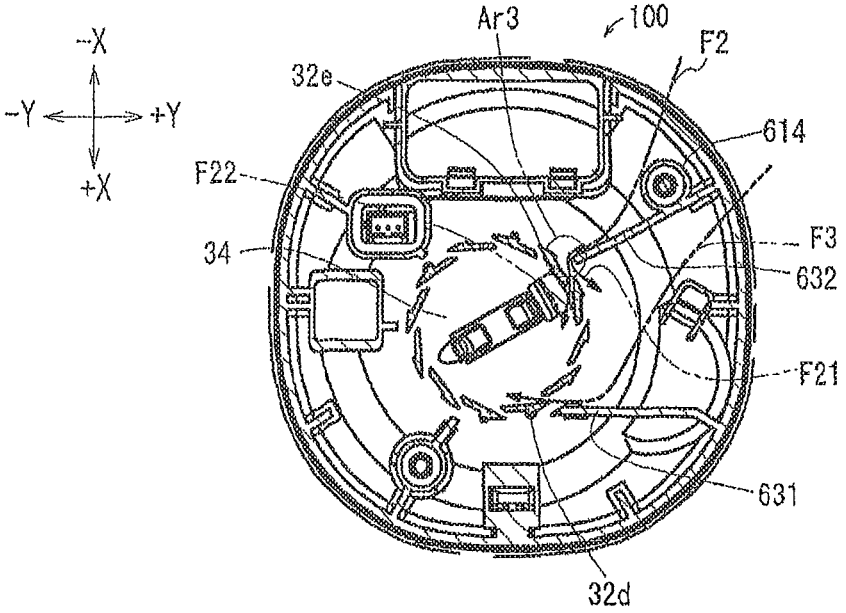
FIG. 27 is a diagram illustrating an air flow in FIG. 22.
Figure 28:
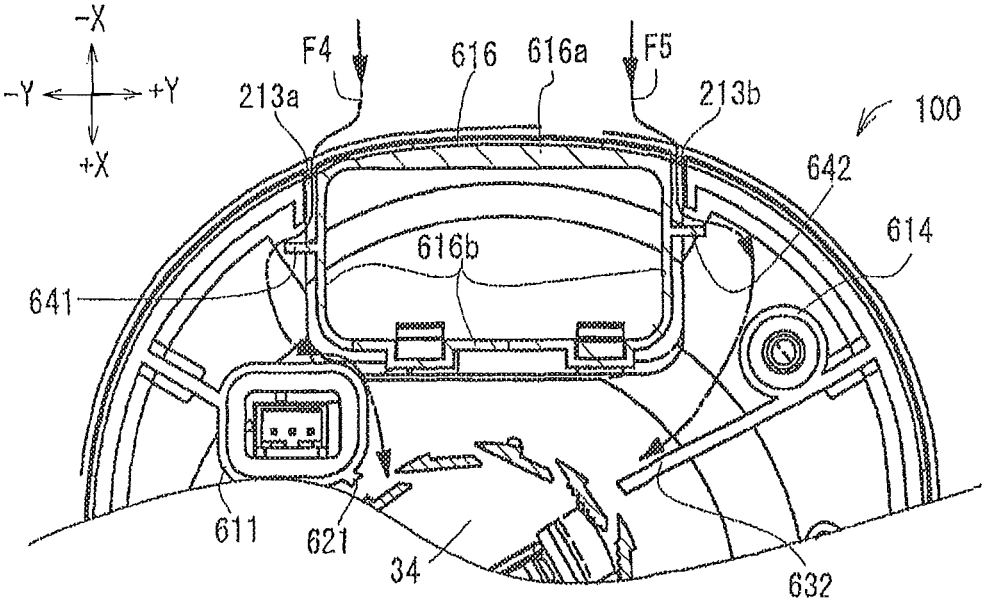
FIG. 28 is a diagram illustrating an air flow in the enlarged view in the periphery of slits 213*a* and 213*b* of FIG. 22.

Next, a gas guiding operation in the alarm device 100 assembled in this way will be described. FIG. 26 is a diagram illustrating the air flow in FIG. 4, FIG. 27 is a diagram illustrating the air flow in FIG. 22, and FIG. 28 is a diagram illustrating the air flow in an enlarged view in the periphery of the slits 213*a* and 213*b* of FIG. 22. Additionally, the arrows F1 to F5, F21, and F22 in these drawings illustrate the direction of the air flow based on a predetermined test or simulation result for a direction in which a gas including smoke flows (that is, an air flow direction). The alarm device 100 can guide the gas moving along the installation surface 900 into the alarm device 100 from all directions outside the casing 2 and can guide the gas to the detection space 34 by using the "inner member of the rear casing 21" including the short fins 621 to 623 and the long fins 631 and 632. However, here, for example, a case in which the gas is guided along the arrows F1 to F5, F21, and F22 of FIGS. 26 to 28 will be described.

As indicated by the arrow F1 of FIG. 26, the gas moving along the installation surface 900 is guided to the outer inflow opening 23 while the movement direction is changed from the direction along the installation surface 900 to the direction along the outer inflow opening 23 by the outer stagnation point P1. In this case, since the front casing side end portion 222*a* is located at the outside in relation to the rear casing side end portion 212*a*, the gas which is guided by the outer stagnation point P1 contacts the front end (the front end surface) at the upper side (the +Z direction) of the front casing side end portion 222*a* so that the gas is reliably guided into the casing 2 through the outer inflow opening 23. Subsequently, the gas which is guided into the casing 2 is guided inward along the flange portion 41 of the detector body 4 and then is guided to the inner stagnation point P2 along the slope portion 42 of the detector body 4. Then, the gas which is guided to the inner stagnation point P2 is guided to the detection space 34 by the inner stagnation point P2. In this case, since the detector body side end portion 400*a* contacts the front casing side end portion 222*a* at the inside thereof as illustrated in FIG. 4, it is possible to shield the gas flowing from the outer inflow opening 23 of FIG. 26 into the casing 2 so that the inflow gas does not enter between the detector body 4 and the front casing 22 and thus to reliably guide the gas flowing from the outer inflow opening 23 into the casing 2 toward the inner stagnation point P2 (that is, toward the detection space 34). Further, in this case, since dust in the gas is generally larger and heavier than particles in smoke, the dust stagnates at the slope portion 42 and does not reach the detection space 34. That is, it is possible to guide the gas (specifically, particles in smoke) to the detection space 34 while preventing dust from entering the detection space 34.

Further, the gas moving in a direction indicated by the arrow F2 of FIG. 27 flows into the casing 2 as described above in, for example, FIG. 26 and is guided to the front end of the long fin 632 on the side of the labyrinth 32*e* along the component casing 614 and the long fin 632 of FIG. 27. In this case, the inner pressure of the casing 2 increases due to the gas flowing into the casing 2, but since the front end of the long fin 632 is separated from the entire labyrinth 32 including the labyrinth 32*e*, the gas moves (flows) through a gap (an opening) between the labyrinth 32 and the front end of the long fin 632 in the area Ar3. For example, the gas which is guided to the front end of the long fin 632 is guided in a direction indicated by the arrow F21 and a direction indicated by the arrow F22 and is reliably guided to the detection space 34.

Further, the gas moving in a direction indicated by the arrow F3 of FIG. 27 is guided to the front end of the long fin 631 on the side of the labyrinth 32*d* along the long fin 631. However, in this case, since the long fin 631 extends on the extension line of the labyrinth 32*d*, the gas which is guided to the front end of the long fin 631 is guided in a direction along the labyrinth 32*d* and is reliably guided to the detection space 34.

Further, the gas moving in a direction indicated by the arrow F4 of FIG. 28 contacts the outer accommodation wall 616*a* at the outside of the alarm device 100. Here, after the gas is guided into the alarm device 100 through the slit 213*a* so that the movement direction is changed by the prevention piece 641, the gas is guided between the inner accommodation walls of the component casing 611 and the component casing 616 and is reliably guided to the detection space 34. In this case, since dust in the gas is received by the prevention piece 641, it is possible to prevent dust from entering the detection space 34.

Further, the gas moving in a direction indicated by the arrow F5 of FIG. 28 contacts the outer accommodation wall 616*a* at the outside of the alarm device 100. Here, after the gas is guided into the alarm device 100 through the slit 213*b* so that the movement direction is changed by the prevention piece 642, the gas is reliably guided to the detection space 34 along the component casing 614 and the long fin 632. In this case, since dust in the gas is received by the prevention piece 642, it is possible to prevent dust from entering the detection space 34.

(Effect of Detailed Configuration)

With the detailed configuration described above, since the inflow gas can be guided to the detection space 34 after the gas is allowed to flow into the alarm device 100 from all directions based on the alarm device 100 of FIG. 4, smoke can be promptly detected.

Further, as illustrated in FIG. 4, since the light emitting portion 52 is configured to emit light toward the ceiling plate 31 (that is, the upper side (the +Z direction)) and the light receiving portion 53 is configured to receive scattered fight at the ceiling plate 31, light is emitted to a side in which dust is not accumulated (that is, the upper side (the +Z direction)). Accordingly, since it is possible to suppress unexpected scattered light due to accumulated dust and to prevent unexpected scattered light from being received by the light receiving portion 53, it is possible to improve smoke detection accuracy of the alarm device 100.

Further, as illustrated in FIGS. 5 and 6, since the front casing 22 and the rear casing 21 can be respectively molded (manufactured) by using molds divided in the Z direction, there is no need to provide a shape punching process in the direction along the XY plane at the time of manufacturing the casing 2 of the alarm device 100 and thus it is possible to decrease the cost of manufacturing the alarm device 100.

Further, since the rear casing 21 of FIG. 5 is formed to have a diameter larger than that of the attachment base 1 and the front casing 22 is formed to have a diameter larger than that of the rear casing 21, the front casing 22 is mainly viewed by the user when the alarm device 100 of FIG. 3 is attached to the installation surface 900 and thus simple and smart impression can be given to the user who sees the alarm device 100 (that is, the design of the alarm device 100 can be improved). Further, since the rear casing side outer peripheral wall 212 and the front casing side outer peripheral wall 222 are inclined as described above, thin and smart impression can be given to the user who sees the alarm device 100 by using a visual effect (that is, the design of the alarm device 100 can be further improved).

According to the embodiment, since the rear casing side outer peripheral wall 212 of FIG. 4 is inclined or the front casing side end portion 222*a* is disposed at the outside in relation to the rear casing side end portion 212*a*, the gas moving along the installation surface 900 is guided into the casing 2. Accordingly, since it is possible to promote, for example, the flow of the gas moving along the installation surface 900 into the casing 2, it is possible to provide the alarm device 100 capable of promptly and reliably detecting the detection target material (in the embodiment, smoke) included in the gas.

Further, since the outer stagnation point P1 of FIG. 4 is formed, it is possible to promote, for example, the flow of the gas moving along the installation surface 900 into the casing 2 through the outer inflow opening 23 and thus to provide the alarm device 100 capable of promptly and reliably detecting the detection target material (in the embodiment, smoke) included in the gas. Further, since it is possible to sufficiently ensure the amount of the gas flowing into the casing 2 without widening, for example, the width of the outer inflow opening 23, it is possible to sufficiently ensure the strength of the casing 2. Accordingly, there is no need to provide the bar-shaped reinforcement member in the outer inflow opening 23, for example, in the extension direction of the outer inflow opening 23. Further, since there is no need to widen, for example, the width of the outer inflow opening 23, it is possible to relatively narrow the width of the outer inflow opening 23 and thus to improve the design of the alarm device 100. Further, since there is no need to separately provide, for example, a component for promoting the inflow of the gas, it is possible to decrease the cost of manufacturing the alarm device 100.

Further, since the front casing side end portion 222*a* of FIG. 4 is disposed at the outside in relation to the rear casing side end portion 212*a*, it is possible to guide the gas to the outer inflow opening 23 by using, for example, the front casing side end portion 222*a* and thus to increase the amount of the gas flowing into the casing 2. Accordingly, it is possible to further promptly detect the detection target material (in the embodiment, smoke) included in the gas.

Further, since the rear casing side outer peripheral wall 212 of FIG. 4 is inclined inward as it goes toward the upper side (the +Z direction), it is possible to give thin and compact impression to the user who sees the alarm device 100 by using, for example, the visual effect for the appearance of the alarm device 100.

Further, since the diameter of the rear casing 21 of FIG. 5 is set to be larger than the diameter of the attachment base 1, it is possible to prevent a problem in which the attachment base 1 is viewed in an exposed state, for example, when the alarm device 100 is attached to the installation surface 900 of FIG. 3. Accordingly, it is possible to improve the design of the alarm device 100.

Further, since the facing surface 211*b* of FIG. 25 guides the gas moving inside the casing 2 to the detection space 34, it is possible to promote, for example, the flow of the gas moving inside the casing 2 into the detection space 34. Accordingly, it is possible to further promptly detect the detection target material (in the embodiment, smoke) included in the gas. Further, since it is possible to sufficiently ensure the amount of the gas flowing into the detection space 34 without widening, for example, the size of the inner inflow opening 35 of FIG. 23, it is possible to relatively decrease the size of the inner inflow opening 35. Accordingly, since it is possible to prevent dust from entering the detection space 34, it is possible to prevent an error based on the entrance of dust into the detection space 34 (that is, the erroneous detection of the detection target material). Here, the "erroneous detection" means that the detection target material is detected by mistake. Specifically, the erroneous detection means that dust or the like is detected by mistake as the detection target material (in the embodiment, smoke). For example, this is a phenomenon which may occur when a relatively large amount of dust enters the detection space 34 of FIG. 4.

Further, according to the embodiment, since the short fins 621 to 623 and the long fins 631 and 632 of FIG. 22 are provided to guide the gas flowing from the outer inflow opening 23 of FIG. 25 toward the inner inflow opening 35 of FIG. 23, it is possible to promote, for example, the flow of the inflow gas from the outer inflow opening 23 of FIG. 25 into the detection space 34 of FIG. 22. Accordingly, it is possible to provide the alarm device 100 capable of promptly and reliably detecting the detection target material (in the embodiment, smoke). In particular, since the front ends of the short fins 621 to 623 and the long fins 631 and 632 on the side of the inner inflow opening 35 of FIG. 23 are not in contact with the labyrinth 32, the gas flowing from the outer inflow opening 23 can be moved between the labyrinth 32*e* and the front end of the long fin 632, for example, as illustrated in FIG. 26. Accordingly, it is possible to further promote the flow of the gas into the detection space 34.

Further, since the front ends of the short fins 621 to 623 and the long fins 631 and 632 of FIG. 23 are disposed in the vicinity of the inner inflow opening 35, for example, the gas can be guided to the vicinity of the inner inflow opening 35 along the short fins 621 to 623 and the long fins 631 and 632. Accordingly, it is possible to further promote the flow of the gas into the detection space 34.

Further, since the long fin 631 of FIG. 26 extends from the outer inflow opening 23 of FIG. 25 toward the inner inflow opening 35*d* of FIG. 23 on the extension line of the labyrinth 32*d*, for example, the gas can be guided to the detection space 34 along the long fin 631 and the labyrinth 32*d*. Accordingly, it is possible to promote the flow of the gas into the detection space 34.

Further, since the long fins 631 and 632 are provided to extend from the rear casing side outer peripheral wall 212 of FIG. 22, it is possible to prevent, for example, a problem in which the gas flowing from the outer inflow opening 23 of FIG. 25 leaks while not reaching the detection space 34 of FIG. 22. Accordingly, it is possible to promote the flow of the gas into the detection space 34.

Further, since the long fins 631 and 632 are provided at the "other arrangement area" of FIG. 22, it is possible to guide the gas by effectively using, for example, a relatively wide space. Accordingly, it is possible to promote the flow of the gas into the detection space 34.

Further, since the short fins 621 to 623 are provided to extend from the component casings 611 to 613 of FIG. 22, it is possible to guide the gas to a position in which the gas is difficult to flow by, for example, the component casings 611 to 613. Accordingly, it is possible to promote the flow of the gas into the detection space 34.

Furthermore, according to the embodiment, since the detection space 34 of FIG. 23 is provided on the side of the installation surface side facing surface 12B of FIG. 3 in relation to the outer inflow opening 23 while any portion of the detection space 34 is not located at the outer inflow opening 23, for example, disturbance entering the casing 2 through the outer inflow opening 23 of FIG. 25 is difficult to reach the detection space 34. Accordingly, it is possible to prevent the erroneous detection of the alarm device 100.

Further, since the detector body 4 of FIG. 25 guiding the gas to the detection space 34 includes the slope portion 42 of FIG. 25 which is inclined with respect to the direction along the installation surface side facing surface 12B of FIG. 3, for example, disturbance entering the casing 2 through the outer inflow opening 23 can be received. Accordingly, it is possible to prevent the erroneous detection of the alarm device 100. Further, for example, since the detector body 4 guides the gas to the detection space 34, it is possible to promptly guide the gas to the detection space 34 and thus to promptly detect the detection target material (in the embodiment, smoke).

Further, since the detector body 4 of FIG. 25 is widened from the detection space 34 to the outer inflow opening 23 so that a gas passage is formed between the outer inflow opening 23 and the detection space 34, it is possible to reliably guide, for example, the gas flowing into the casing 2 through the outer inflow opening 23 to the detection space 34 and thus to reliably detect the detection target material (in the embodiment, smoke).

Furthermore, according to the embodiment, since the rear casing 21 and the front casing 22 of FIG. 3 are combined with each other so that a gap corresponding to the outer inflow opening 23 is formed between the rear casing 21 and the front casing 22, the outer inflow opening 23 is also formed, for example, when the rear casing 21 and the front casing 22 are combined with each other. For this reason, since a step of only forming the outer inflow opening 23 is omitted, it is possible to simplify a step of forming the casing 2 and to decrease the cost of manufacturing the alarm device 100.

Further, since the ribs 651 to 659 of FIG. 9 define the outer inflow opening 23 of FIG. 4 and the gas passage extending from the outer inflow opening 23 to the detection space 34, it is possible to guide the gas in an intended direction, for example, through the outer inflow opening 23 and the passage defined as described above. Accordingly, since it is possible to prevent a problem in which the gas flowing into the casing 2 leaks while not reaching the detection space 34, it is possible to provide the alarm device 100 capable of promptly and reliably detecting the detection target material (in the embodiment, smoke).

Further, since the rib 65 (which is the representative name of the ribs 651 to 659) illustrated in FIG. 6 fixes and supports the front casing 22 to the rear casing 21, it is possible to prevent, for example, the relative positional deviation between the rear casing 21 and the front casing 22. Accordingly, since it is possible to prevent the deformation of the casing 2, it is possible to further strengthen the alarm device 100.

Furthermore, according to the embodiment, since the slits 213*a* and 213*b* allowing the gas to flow into the casing 2 of FIG. 1 communicate with the outer inflow opening 23 in a direction orthogonal to the outer inflow opening 23, for example, the external gas of the casing 2 can be allowed to flow into the casing 2 through not only the outer inflow opening 23, but also the slits 213*a* and 213*b*. Accordingly, since it is possible to promote the flow of the gas into the casing 2, it is possible to provide the alarm device 100 capable of promptly and reliably detecting the detection target material (in the embodiment, smoke). Further, since it is possible to sufficiently ensure the amount of the gas flowing into the casing 2 without widening, for example, the width of the outer inflow opening 23, it is possible to sufficiently ensure the strength of the casing 2. Accordingly, there is no need to provide the bar-shaped reinforcement member in the outer inflow opening 23, for example, in the extension direction of the outer inflow opening 23. Further, since there is no need to widen, for example, the width of the outer inflow opening 23, it is possible to relatively narrow the width of the outer inflow opening 23 and thus to improve the design of the alarm device 100. Further, since there is no need to particularly provide, for example, a component for promoting the inflow of the gas, it is possible to decrease the cost of providing the alarm device 100.

Further, since the prevention pieces 641 and 642 of FIG. 22 are provided at positions facing the slits 213*a* and 213*b* of FIG. 22 inside the casing 2 of FIG. 1, dust in the gas is received by, for example, the prevention pieces 641 and 642. Accordingly, it is possible to prevent dust from entering the detection space 34.

Further, since the slits 213*a* and 213*b* of FIG. 22 are provided at both sides of the component casing 616 in the rear casing side outer peripheral wall 212, it is possible to promote, for example, the inflow of the gas in the periphery of the portion without the outer inflow opening 23 of FIG. 1 in the rear casing side outer peripheral wall 212 (that is, the portion provided with the component casing 616) and to provide the alarm device 100 capable of promptly and reliably detecting the detection target material (in the embodiment, smoke).

Further, since the component casing 616 of FIG. 22 is used to accommodate a battery (not illustrated), it is necessary to relatively increase, for example, the size of the component casing 616. Accordingly, since it is possible to promote the inflow of the gas in the periphery of the portion without the outer inflow opening 23 of FIG. 1 in a relatively long distance in the rear casing side outer peripheral wall 212, it is possible to provide the alarm device 100 capable of promptly and reliably detecting the detection target material (in the embodiment, smoke).

Furthermore, according to the embodiment, since the gas is guided from the outer inflow opening 23 of FIG. 4 toward the detection space 34 of FIG. 22, it is possible to promote, for example, the flow of the gas from the outer inflow opening 23 of FIG. 4 to the detection space 34 of FIG. 22 and thus to provide the alarm device 100 capable of promptly and reliably detecting the detection target material (in the embodiment, smoke).

Further, since the component casings 611 to 616 of FIG. 22 serve as guide means, there is no need to provide, for example, a dedicated component for guiding the gas. Accordingly, it is possible to decrease the number of components of the alarm device 100 and to decrease the cost of manufacturing the alarm device 100.

Further, since the outer accommodation wall 616*a* of the component casing 616 forms a part of the rear casing side outer peripheral wall 212, for example, the component casing 616 itself can be provided at a position close to the outside of the casing 2 of FIG. 4. Accordingly, since it is possible to ensure a sufficient area for guiding the gas in the periphery of the detection space 34 of FIG. 22 inside the casing 2, it is possible to promote the flow of the gas from the outer inflow opening 23 of FIG. 4 into the detection space 34 of FIG. 22.

Further, since the ribs 651, 652, 654, and 659 are provided to combine the component casings 611 to 614 with the rear casing side outer peripheral wall 212, it is possible to guide the gas, for example, along the ribs 651, 652, 654, and 659 and the component casing 616 to 614 and thus to promote the flow of the gas from the outer inflow opening 23 of FIG. 4 to the detection space 34 of FIG. 22.

Further, since the short fins 621 to 623 and the long fin 632 are provided to protrude from the component casings 611 to 614 toward the detection space 34, it is possible to guide the gas, for example, along the component casings 611 to 614, the short fins 621 to 623, and the long fin 632 and thus to promote the flow of the gas from the outer inflow opening 23 of FIG. 4 to the detection space 34 of FIG. 22.

Modified Example of Embodiment

Although the embodiment according to the invention has been described above, the detailed configuration and means of the invention can be arbitrarily modified and improved within the scope of the technical idea of each invention described in the claims. Hereinafter, such a modified example will be described.

(Regarding Problems to be Solved or Effect of Invention)

Above all, problems to be solved by the invention and effect of the invention are not limited to the contents described above, but may differ according to the implementation environment and configuration of the invention. That is, only some of the above-described problems may be solved or only a part of the above-described effect may be obtained.

(Regarding Distribution or Integration)

In addition, the above-described configuration is a functional concept and is not necessarily and physically limited to the configuration illustrated in the drawings. In other words, specific forms of distribution and integration of the components are not limited to those illustrated in the drawings and all or a part of them may be configured to be distributed or integrated functionally or physically by arbitrary units. For example, the casing 2 and the attachment base 1 of the alarm device 100 may be integrated and the integrated configuration may be directly attached to the installation surface of the monitoring area.

(Regarding Shape of Rear Casing)

Further, in the above-described embodiment, a case has been described in which the rear casing side outer peripheral wall 212 illustrated in FIG. 4 is inclined inward as it goes toward the upper side (the +Z direction), but the invention is not limited thereto. For example, the rear casing side outer peripheral wall 212 may be inclined outward as it goes toward the upper side (the +Z direction). In this case, the outer stagnation point P1 of FIG. 4 is not formed, but the gas moving along the installation surface 900 can be guided along the rear casing side outer peripheral wall 212 which is inclined outward with respect to the outer inflow opening 23. Further, for example, the tear casing side outer peripheral wall 212 may be formed to straightly extend in the height direction (the Z direction) while not being inclined and then the function of the rear casing side outer peripheral wall 212 may be realized in the modified example by using the attachment base 1. Specifically, the thickness of the attachment base 1 may be set to be the same as the length of the rear casing side outer peripheral wall 212 in the height direction (the Z direction), the diameter of the attachment base 1 facing the rear casing 21 may be set to be the same as that of the rear casing 21, and then the diameter of the attachment base 1 may be increased as it goes upward (that is, the +Z direction). In this case, the attachment base 1 may be formed transparently so that the attachment base 1 is not easily visually recognized.

(Regarding Inner Member of Rear Casing 21—First)

Further, in the above-described embodiment, a case in which the "inner member of the rear casing 21" has a configuration illustrated in FIG. 22 has been described, but the invention is not limited thereto. For example, the configuration (for example, the shape, the size, the number, and the arrangement position) of the "inner member of the rear casing 21" may be omitted, changed, or added in response to the configuration (for example, the shape, the size, the number, and the arrangement position) of the component to be accommodated, the configuration (for example, the shape, the size, and the requested strength) of the rear casing 21 itself and the air flow. In particular, for the long fins 631 and 632 of FIG. 22, only one long fin having the same configuration may be provided or three or more long fins having the same configuration may be provided. Further, the long fins 631 and 632 may be formed to extend from a predetermined position other than the ribs 657 and 659. Specifically, the long fins 631 and 632 may be formed to extend from a position without the rib 65 in the rear casing side outer peripheral wall 212, may be formed to extend from the component casings 611 to 616, or may be formed to extend from a position separated from the rear casing side outer peripheral wall 212 and the component casings 611 to 616. Further, the long fins 631 and 632 may not extend as a straight line. Specifically, the long fins may be bent or curved. Further, for the short fins 621 to 623, only one short fin having the same configuration may be provided, two or more short fins may be provided, or four or more short fins may be provided. Further, the short fins 621 to 623 may be formed to protrude from a predetermined position other than the component casings 611 to 613. Specifically, the short fins may be formed to protrude from the component casings 614 to 616, may be formed to protrude from the rib 65, or may be formed to protrude from a position without the rib 65 in the rear casing side outer peripheral wall 212. Further, the ribs 651 to 659 of FIG. 22 may be formed to define only the outer inflow opening 23 or the gas passage in the outer inflow opening 23 and the gas passage extending from the outer inflow opening 23 to the detection space 34. Additionally, in the case of only forming the passage, specifically, the ribs 651 to 659 may be provided at the inside of the rear casing 21 while being separated from the rear casing side outer peripheral wall 212 so as not to contact the rear casing side outer peripheral wall 212 of FIG. 9. Further, the length of the rib 65 (which is the representative name of the ribs 651 to 659) in the direction along the XY plane may be appropriately extended to the vicinity of the labyrinth 32. Further, for example, the long fin 631 of FIG. 22 may be provided by the combination with the component casing having the same configuration as the component casing 614 similarly to the long fin 632 and the long fin 631 may be used as the protrusion of the "constituent accommodation means". Further, for example, similarly to the component casings 611 to 614, the component casing 615 may be provided at a position separated from the rear casing side outer peripheral wall 212, the protrusion serving as guide means may be provided, and the rib 655 of FIG. 9 may be used as the combination wall for combining the rear casing side outer peripheral wall 212 and the component casing 615 with each other, so that the "protrusion serving as the guide means" may be used as "second constituent accommodation means" along with the rib 655 and the component casing 615.

(Regarding Inner Member of Rear Casing 21—Second)

Further, in the above-described embodiment, a case in which the "inner member of the rear casing 21" of FIG. 9 is integrated with the rear casing 21 has been described, but the invention is not limited thereto. For example, at least a part of the "inner member of the rear casing 21" of FIG. 9 may be integrally formed with the detector body 4 of FIG. 6 or may be formed separately from the rear casing 21 and the detector body 4 and may be fixed to the rear casing 21 or the detector body 4 by using, for example, fixing means such as an adhesive.

(Regarding Rib)

Further, in the above-described embodiment, as illustrated in FIG. 6, a case in which the rib 65 (which is the representative name of the ribs 651 to 659) is integrally formed with the rear casing 21 has been described, but the invention is not limited thereto. For example, the rib 65 may be integrally formed with the front casing 22. In this case, the rib 65 provided in the front casing 22 serves as fixing and supporting means for fixing and supporting the rear casing 21 to the front casing 22. Further, the front casing 22 corresponds to "one accommodation means" and the rear casing 21 corresponds to the "other accommodation means". Further, for example, a "part of ribs" in the rib 65 may be integrally formed with the front casing 22 and "another rib" corresponding to ribs other than a "part of ribs" in the rib 65 may be integrally formed with the rear casing 21. Further, in the above-described embodiment, a case has been described in which all ribs 65 (which is the representative name of the ribs 651 to 659) illustrated in FIG. 6 contact the positioning recess portion 411 of the flange portion 41 of the detector body 4, but the invention is not limited thereto. For example, at the time of assembling the alarm device 100 after a portion corresponding to the positioning recess portion 411 of at least a part of the positioning recess portions 411 of the flange portion 41 of the detector body 4 is notched and the rib 65 (hereinafter, the facing rib) facing the notched portion in the flange portion 41 is directly brought into contact with the front casing 22, the "facing rib" may contact the front casing 22 so that the front casing 22 is fixed and supported to the rear casing 21.

(Regarding Detection Space)

Further, in the above-described embodiment, a case has been described in which the detection space 34 of FIG. 4 is disposed so that the entire detection space 34 is provided at the upper side (that is, the +Z direction) in relation to the outer inflow opening 23 while any portion of the detection space 34 is not located at the outer inflow opening 23, but the invention is not limited thereto. For example, the detection space 34 of FIG. 4 may be disposed so that the entire detection space 34 is provided at the lower side (that is, the −Z direction) in relation to the outer inflow opening 23 while any portion of the detection space 34 is not located at the outer inflow opening 23. In this case, for example, when the alarm device 100 of the modified example is attached to the installation surface 900 and the "wall installation surface", it is possible to prevent dust or disturbing light from entering the detection space 34 and thus to improve smoke detection accuracy of the alarm device 100. In both cases, when the inflow gas is guided to the detection space 34 while preventing the entrance of disturbance of the detection space 34, it is possible to promptly and reliably detect smoke while preventing the erroneous detection and thus to improve the smoke detection accuracy.

(Regarding Slit)

Further, in the above-described embodiment, a case in which the slits 213*a* and 213*b* of FIG. 11 are provided has been described, but the invention is not limited thereto. For example, only one or two or more slits (hereinafter, the slits of the modified example) having the same function as those of the slits 213*a* and 213*b* may be provided instead of the slits 213*a* and 213*b*. Further, for example, the "slit of the modified example" may be provided at a portion other than both sides of the component casing 616 of the rear casing 21 or the front casing 22, may be provided at a position separated from the outer inflow opening 23 (that is, in a state where the slit does not communicate with the outer inflow opening 23), or may be provided in a predetermined direction (for example, the extension direction of the outer inflow opening 23) regardless of the extension direction of the outer inflow opening 23.

(Regarding Detection Target Material)

Further, in the above-described embodiment, a case has been described in which the "detection target material" is "smoke" and the "alarm device" is a "fire alarm (a smoke alarm)", but the invention is not limited thereto. For example, also in a case in which the "detection target material" is, for example, a (toxic) gas such as "carbon monoxide" and the "alarm device" is a "gas alarm", the invention can be applied.

(Regarding Detector Body)

Further, in the above-described embodiment, a case has been described in which the detector body side end portion 400*a* of FIG. 4 contacts the front casing side end portion 222*a* at the inside thereof, but the invention is not limited thereto. For example, in consideration of the intersection or the like of the component of the alarm device 100 (for example, the detector body 4 or the front casing 22), the detector body side end portion 400*a* and the front casing side end portion 222*a* may not contact each other or may be adjacent to each other to be separated from each other with a slight gap (for example, several millimeters) interposed therebetween. Further, if the promotion of the flow of the gas from the outside of the casing 2 into the casing 2 through the outer inflow opening 23 is observed when such a slight gap is formed between the detector body side end portion 400*a* and the front casing side end portion 222*a*, the alarm device 100 may be formed so that the gap is explicitly formed in consideration of; for example, the degree of promotion of the inflow of the gas due to the reduction of the internal pressure of the casing 2 caused by the movement of the gas through the gap between the detector body 4 and the front casing 22.

(Regarding Inner Stagnation Point)

Further, in the above-described embodiment, a case has been described in which the inner stagnation point P2 is formed between the facing surface 211*b* and a part of the detector cover 3 (for example, the ceiling plate 31) of FIG. 25, but the invention is not limited thereto. For example, there is a case in which the inner stagnation point P2 is formed between the facing surfaces 211*b* and 211*c* and a part of the detector cover 3 (for example, the ceiling plate 31, (through the insect screen 33) the labyrinth 32) of FIG. 25 in response to the flow rate and the flow amount of the gas flowing into the casing 2 of FIG. 4. Also in this case, the gas can be guided to the detection space 34 by the formed inner stagnation point P2.

(Regarding Attachment of Alarm Device)

Further, in the above-described embodiment, a case in which the alarm device 100 of FIG. 3 is attached to the installation surface 900 has been described, but the invention is not limited thereto. For example, the alarm device 100 may be attached to the "wall installation surface (not illustrated)". Also in this case, it is possible to obtain the same effect as in a case in which the alarm device 100 is attached to the installation surface 900.

(Regarding Opening of Casing)

Further, in the above-described embodiment, the casing 2 may not be provided with any opening other than the outer inflow opening 23 illustrated in FIG. 3. That is, any opening may not be provided at the upper side (the +Z direction) in relation to the two-dotted chain line at the upper side (the +Z direction) among two two-dotted chain lines extending in the Y direction of FIG. 23.

One embodiment of the present invention provides an alarm device that is attached to an installation surface of an installation object and has an attachment surface facing the installation surface, the alarm device comprising: detection means for detecting a detection target material included in a gas; accommodation means for accommodating the detection means; and guide means for guiding the gas into the accommodation means.

According to the above embodiment, since the guide means guides a gas into the accommodation means, for example, it is possible to promote the flow of the gas into the accommodation means. As a result, it is possible to provide an alarm device capable of promptly and reliably detecting a detection target material.

Another embodiment of the present invention provides the alarm device according to the above embodiment, wherein the guide means includes outer guide means for guiding the gas into the accommodation means, wherein the accommodation means includes a first inflow opening for allowing the gas to flow into the accommodation means, and wherein the outer guide means allows the gas moving along the installation surface to flow into the accommodation means through the first inflow opening.

According to the above embodiment, since the outer guide means guides a gas moving along the installation surface into the accommodation means, it is possible to promote, for example, the flow of the gas moving along the installation surface into the accommodation means. As a result, it is possible to provide an alarm device capable of promptly and reliably detecting a detection target material.

Another embodiment of the present invention provides the alarm device according to the above embodiment, wherein the accommodation means includes an outer wall, wherein the first inflow opening is provided in the outer wall to extend in a direction along the attachment surface, and wherein the outer guide means includes first outer guide means formed by inclining a first outer wall with respect to a direction orthogonal to a direction along the attachment surface so that a space generating an air flow for guiding the gas to the first inflow opening is formed between the installation surface and the first outer wall corresponding to a part at the side of the attachment surface with respect to the first inflow opening in the outer wall.

According to the above embodiment, since a space for generating the air flow for guiding a gas to the first inflow opening is provided, it is possible to promote, for example, the flow of the gas moving along the installation surface into the accommodation means through the first inflow opening. As a result, it is possible to provide an alarm device capable of promptly and reliably detecting a detection target material. Further, since it is possible to sufficiently ensure, for example, the amount of the gas flowing into the accommodation means without widening the width of the first inflow opening, it is possible to sufficiently ensure the strength of the accommodation means. For this reason, there is no need to provide, for example, a bar-shaped reinforcement member in the first inflow opening in the extension direction of the first inflow opening. Further, since there is no need to widen, for example, the width of the first inflow opening, the width of the first inflow opening can be set to be relatively narrow and thus the design of the alarm device can be improved. Further, since there is no need to particularly provide, for example, a component for promoting the inflow of the gas, it is possible to decrease the alarm device providing cost.

Another embodiment of the present invention provides the alarm device according to the above embodiment, wherein the accommodation means includes an outer wall, wherein the first inflow opening is provided at the outer wall to extend in a direction along the attachment surface, and wherein the outer guide means includes second outer guide means formed by disposing an end portion of a second outer wall corresponding to a part on the opposite side to the attachment surface with respect to the first inflow opening in the outer wall in relation to an end portion of the first outer wall corresponding to a part at the side of the attachment surface with respect to the first inflow opening in the outer wall at the outside of the accommodation means in a direction along the attachment surface.

According to the above embodiment, since the end portion of the second outer wall is disposed at the outside of the accommodation means in relation to the end portion of the first outer wall, it is possible to guide a gas to the first inflow opening by using, for example, the end portion of the second outer wall. Accordingly, it is possible to increase the amount of the gas flowing into the accommodation means and to further promptly detect the detection target material.

Another embodiment of the present invention provides the alarm device according to the above embodiment, wherein the first outer wall is inclined in a direction along the attachment surface toward the inside of the accommodation means as it goes toward the installation surface.

According to the above embodiment, since the first outer wall is inclined toward the inside of the accommodation means in a direction along the installation surface as it goes toward the installation surface, it is possible to give a thin and compact impression to a user who uses the alarm device by using, for example, a visual effect for the appearance of the alarm device.

Another embodiment of the present invention provides the alarm device according to the above embodiment, further comprising: attachment means including the attachment surface, provided between the installation surface and the accommodation means, and attaching the accommodation means to the installation surface, wherein the accommodation means includes an outer wall, wherein the first inflow opening is provided in the outer wall to extend in a direction along the attachment surface, wherein the accommodation means includes first accommodation means corresponding to a part at the side of the attachment surface with respect to the first inflow opening and second accommodation means corresponding to a part on the opposite side to the attachment surface with respect to the first inflow opening, and wherein a diameter of the first accommodation means is set to be larger than a diameter of the attachment means.

According to the above embodiment, since the diameter of the first accommodation means is set to be larger than the diameter of the attachment means, it is possible to prevent the attachment means from being viewed in an exposed state, for example, when the alarm device is attached to the installation surface. Accordingly, it is possible to improve the design of the alarm device.

Another embodiment of the present invention provides the alarm device according to the above embodiment, wherein the detection means includes a partition member that defines a detection space for detecting the detection target material and a second inflow opening that allows the gas to flow into the detection space and is provided in the partition member, wherein the accommodation means includes a facing surface facing a side provided with the second inflow opening in the partition member at the outside of the detection space inside the accommodation means, wherein the alarm device further comprises inner guide means for guiding the gas moving inside the accommodation means to the detection space through the second inflow opening, and wherein the inner guide means is formed by separating the facing surface from the partition member not to be in contact with the partition member so that a space generating an air flow for guiding the gas moving inside the accommodation means to the second inflow opening is formed between the facing surface and the partition member.

According to the above embodiment, since the inner guide means guides a gas moving inside the accommodation means to the detection space, it is possible to promote, for example, the flow of the gas moving inside the accommodation means into the detection space. As a result, it is possible to further promptly detect the detection target material. Further, since it is possible to sufficiently ensure, for example, the amount of the gas flowing into the detection space without widening the size of the second inflow opening, it is possible to relatively decrease the size of the second inflow opening. Accordingly, it is possible to prevent dust from entering the detection space and to prevent an error based on the entrance of dust into the detection space (that is, the erroneous detection of the detection target material).

Another embodiment of the present invention provides the alarm device according to the above embodiment, wherein the accommodation means includes a first inflow opening that allows the gas to flow into the accommodation means, wherein the detection means includes a partition wall that defines a detection space for detecting the detection target material and a second inflow opening that allows the gas to flow into the detection space, wherein the guide means is a guide piece that guides the gas flowing from the first inflow opening to the second inflow opening, and wherein a front end of the guide piece at the side of the second inflow opening is not in contact with the partition wall.

According to the above embodiment, since the guide piece is provided to guide a gas flowing from the first inflow opening toward the second inflow opening, it is possible to promote, for example, the flow of the gas flowing from the first inflow opening into the detection space. As a result, it is possible to provide an alarm device capable of promptly and reliably detecting a detection target material. In particular, since the front end of the guide piece at the side of the second inflow opening is not in contact with the partition wall, it is possible to move, for example, the gas flowing from the first inflow opening between the front end of the guide piece and the partition wall and thus to further promote the flow of the gas into the detection space.

Another embodiment of the present invention provides the alarm device according to the above embodiment, wherein the front end of the guide piece is disposed in the vicinity of the second inflow opening.

According to the above embodiment, since the front end of the guide piece is disposed in the vicinity of the second inflow opening, it is possible to guide a gas to the vicinity of the second inflow opening, for example, along the guide piece and thus to further promote the flow of the gas into the detection space.

Another embodiment of the present invention provides the alarm device according to the above embodiment, wherein the second inflow opening is formed as a gap between the plurality of partition walls, and wherein the guide piece extends from the first inflow opening toward the second inflow opening on an extension line of at least one partition wall among the plurality of partition walls.

According to the above embodiment, since the guide piece extends from the first inflow opening toward the second inflow opening on the extension line of the partition wall, it is possible to guide a gas to the detection space, for example, along the guide piece and the partition wall and thus to promote the flow of the gas into the detection space.

Another embodiment of the present invention provides the alarm device according to the above embodiment, wherein the guide piece includes a first guide piece that extends from an outer wall of the accommodation means.

According to the above embodiment, since the first guide piece is provided to extend from the outer wall of the accommodation means, it is possible to prevent, for example, the outflow of the gas flowing from the first inflow opening while the gas does not reach the detection space and thus to promote the flow of the gas into the detection space.

Another embodiment of the present invention provides the alarm device according to the above embodiment, wherein an electric constituent arrangement area in which an electric constituent of the alarm device is disposed and an electric constituent non-arrangement area in which the electric constituent is not disposed are provided inside the accommodation means, and wherein the first guide piece is provided in the electric constituent non-arrangement area.

According to the above embodiment, since the first guide piece is provided in the electric constituent non-arrangement area, it is possible to guide a gas while efficiently using, for example, a relatively wide space and thus to promote the flow of the gas into the detection space.

Another embodiment of the present invention provides the alarm device according to the above embodiment, further comprising: constituent accommodation means provided inside the accommodation means and accommodating constituents of the alarm device, wherein the guide piece includes a second guide piece that extends from the constituent accommodation means.

According to the above embodiment, since the second guide piece extending from the constituent accommodation means is provided, it is possible to guide a gas to a position where the gas cannot easily flow by, for example, the constituent accommodation means and thus to promote the flow into the detection space.

Another embodiment of the present invention provides the alarm device according to the above embodiment, wherein the accommodation means includes an inflow opening that extends in a direction along the attachment surface and allows the gas to flow into the accommodation means, wherein the detection means includes a detection space and detects the detection target material existing in the detection space, and wherein the detection space of the detection means is provided at the side of the attachment surface in relation to the inflow opening so that any portion of the detection space is not located at the inflow opening.

According to the above embodiment, since the detection space of the detection means is provided at the side of the installation surface in relation to the inflow opening while any portion of the detection space is not located at the inflow opening, for example, disturbance (for example, dust, water vapor, or disturbing light) entering the accommodation means through the inflow opening cannot easily reach the detection space. As a result, it is possible to prevent an erroneous detection of the alarm device.

Another embodiment of the present invention provides the alarm device according to the above embodiment, further comprising: arrangement means provided inside the accommodation means so that the detection means is disposed thereon, wherein the arrangement means includes a slope surface that is inclined with respect to a direction along the attachment surface to guide the gas flowing from the inflow opening to the detection means.

According to the above embodiment, since the arrangement means for guiding a gas to the detection means includes the slope surface inclined with respect to a direction along the installation surface, it is possible to receive, for example, disturbance entering the accommodation means through the inflow opening and thus to prevent an erroneous detection of the alarm device. Further, since the arrangement means guides, for example, a gas to the detection means, it is possible to promptly guide the gas to the detection space and thus to promptly detect the detection target material.

Another embodiment of the present invention provides the alarm device according to the above embodiment, wherein the arrangement means is widened from the detection means to the inflow opening so that the gas passage is formed between the inflow opening and the detection means.

According to the above embodiment, since the arrangement means is widened from the detection means toward the inflow opening so that the gas passage is formed between the inflow opening and the detection means, it is possible to reliably guide, for example, a gas entering the accommodation means through the inflow opening to the detection means and thus to reliably detect the detection target material.

Another embodiment of the present invention provides the alarm device according to the above embodiment, wherein the accommodation means includes an inflow opening that allows the gas to flow thereinto, wherein the alarm device further comprises: first accommodation means for covering the detection means from the side of the attachment surface; and second accommodation means for covering the detection means from the opposite side to the attachment surface, and wherein the first accommodation means and the second accommodation means are combined with each other so that a gap corresponding to the inflow opening is formed between the first accommodation means and the second accommodation means.

According to the above embodiment, since the first accommodation means and the second accommodation means are combined with each other so that a gap corresponding to the inflow opening is formed between the first accommodation means and the second accommodation means, the inflow opening is also formed, for example, when the first accommodation means and the second accommodation means are combined with each other. For this reason, since a step of only forming the inflow opening is omitted, it is possible to simplify the step of forming the accommodation means and to decrease the alarm device manufacturing cost.

Another embodiment of the present invention provides the alarm device according to the above embodiment, further comprising: inflow partition means for defining at least one of the inflow opening and a guide space extending from the inflow opening between the first accommodation means and the second accommodation means to the detection means and guiding the gas to the detection means.

According to the above embodiment, since the inflow partition means defines at least one of the inflow opening and the guide space extending from the inflow opening to the detection means, it is possible to guide, for example, a gas through the defined inflow opening or guide space in a desired direction and thus to prevent the outflow of the gas flowing into the accommodation means while the gas does not reach the detection means. As a result, it is possible to provide an alarm device capable of promptly and reliably detecting a detection target material.

Another embodiment of the present invention provides the alarm device according to the above embodiment, wherein the inflow partition means is integrated with one accommodation means of the first accommodation means and the second accommodation means, protrudes toward the other accommodation means of the first accommodation means and the second accommodation means, and fixes and supports the other accommodation means to one accommodation means.

According to the above embodiment, since the inflow partition means fixes and supports the other accommodation means to one accommodation means, it is possible to prevent, for example, a positional deviation between the first accommodation means and the second accommodation means. Accordingly, it is possible to prevent the deformation of the accommodation means and to further strongly increase the strength of the alarm device.

Another embodiment of the present invention provides the alarm device according to the above embodiment, wherein the accommodation means includes an inflow opening allowing the gas to flow thereinto and a slit allowing the gas to flow thereinto, wherein the inflow opening extends in a direction along the attachment surface, and wherein the slit communicates with the inflow opening while being orthogonal to the inflow opening.

According to the above embodiment, since the slit which allows a gas to flow into the accommodation means communicates with the inflow opening while being orthogonal to the inflow opening, it is possible to allow, for example, an external gas of the accommodation means to flow into the accommodation means through the slit as well as the inflow opening and thus to promote the flow of the gas into the accommodation means. As a result, it is possible to provide an alarm device capable of promptly and reliably detecting a detection target material. Further, since it is possible to sufficiently ensure, for example, the amount of the gas flowing into the accommodation means without widening the width of the inflow opening, it is possible to sufficiently ensure the strength of the accommodation means. For this reason, there is no need to provide, for example, a bar-shaped reinforcement member in the inflow opening in the extension direction of the inflow opening. Further, since there is no need to widen, for example, the width of the inflow opening, the width of the inflow opening can be set to be relatively narrow and thus the design of the alarm device can be improved. Further, since there is no need to particularly provide, for example, a component for promoting the inflow of the gas, it is possible to decrease the alarm device providing cost.

Another embodiment of the present invention provides the alarm device according to the above embodiment, further comprising: a prevention piece that prevents dust included in the gas from entering the detection means, wherein the prevention piece is provided at a position facing the slit inside the accommodation means.

According to the above embodiment, since the prevention piece is provided at a position facing the slit inside the accommodation means, dust in the gas is received by, for example, the prevention piece. Accordingly, it is possible to prevent dust from entering the detection means.

Another embodiment of the present invention provides the alarm device according to the above embodiment, wherein the accommodation means includes constituent accommodation means for accommodating a constituent of the alarm device, wherein the constituent accommodation means forms a part of an outer wall of the accommodation means, and wherein the slit is provided at both sides of the constituent accommodation means in the outer wall of the accommodation means.

According to the above embodiment, since the slit is provided at both sides of the constituent accommodation means of the outer wall of the accommodation means, it is possible to promote, for example, the flow of the gas in the periphery of the portion not provided with the inflow opening of the outer wall of the accommodation means (that is, the portion provided with the constituent accommodation means). As a result, it is possible to provide an alarm device capable of promptly and reliably detecting a detection target material.

Another embodiment of the present invention provides the alarm device according to the above embodiment, wherein the constituent is a battery corresponding to a power supply of the alarm device.

According to the above embodiment, since the constituent is the battery, there is a need to set, for example, the size of the constituent accommodation means to be relatively large. Accordingly, it is possible to promote the inflow of the gas in the periphery of the portion without the inflow opening in a relatively long distance of the outer wall of the accommodation means. As a result, it is possible to provide an alarm device capable of promptly and reliably detecting a detection target material.

Another embodiment of the present invention provides the alarm device according to the above embodiment, further comprising: constituent accommodation means for accommodating a constituent of the alarm device other than the detection means, wherein the accommodation means includes an inflow opening that allows the gas to flow thereinto and accommodates the detection means and the constituent accommodation means, and wherein the constituent accommodation means includes the guide means for guiding the gas from the inflow opening to the detection means and extending from an outer wall of the accommodation means to the detection means.

According to the above embodiment, since a gas is guided from the inflow opening toward the detection means, it is possible to promote, for example, the flow of the gas entering from the inflow opening into the detection means. As a result, it is possible to provide an alarm device capable of promptly and reliably detecting a detection target material.

Another embodiment of the present invention provides the alarm device according to the above embodiment, wherein the constituent accommodation means includes an accommodation wall that defines a constituent accommodation space accommodating the constituent, and wherein the guide means is the accommodation wall.

According to the above embodiment, since the guide means is the accommodation wall, there is no need to provide, for example, a dedicated component for guiding a gas. As a result, it is possible to decrease the number of components of the alarm device and to decrease the alarm device providing cost.

Another embodiment of the present invention provides the alarm device according to the above embodiment, wherein the constituent accommodation means includes first constituent accommodation means in which a first portion of the accommodation wall forms the outer wall of the accommodation means, and wherein the guide means is a second portion other than the first portion in the accommodation wall of the first constituent accommodation means.

According to the above embodiment, since the first portion of the accommodation wall of the first constituent accommodation means forms the outer wall of the accommodation means, it is possible to provide, for example, the first constituent accommodation means itself at a position close to the outside of the accommodation means. As a result, it is possible to ensure a sufficient area for guiding a gas in the periphery of the detection means inside the accommodation means and thus to promote the flow of the gas flowing from the inflow opening into the detection means.

Another embodiment of the present invention provides the alarm device according to the above embodiment, wherein the constituent accommodation means includes second constituent accommodation means in which the entire accommodation wall is separated from the outer wall of the accommodation means, wherein the second constituent accommodation means includes a combination wall that combines the accommodation wall of the second constituent accommodation means with the outer wall of the accommodation means, and wherein the guide means is the combination wall.

According to the above embodiment, since the combination wall is provided for the combination between the accommodation wall and the outer wall of the accommodation means, it is possible to guide a gas, for example, along the combination wall and the accommodation wall and thus to promote the flow of the gas flowing from the inflow opening into the detection means.

Another embodiment of the present invention provides the alarm device according to the above embodiment, wherein the second constituent accommodation means includes a protrusion that protrudes from the accommodation wall of the second constituent accommodation means toward the detection means, and wherein the guide means is the protrusion.

According to the above embodiment, since the protrusion is provided to protrude from the accommodation wall toward the detection means, it is possible to guide a gas, for example, along the accommodation wall and the protrusion and thus to promote the flow of the gas flowing from the inflow opening into the detection means.

REFERENCE SIGNS LIST

1 Attachment base
2 Casing
3 Detector cover
4 Detector body
5 Circuit unit
11 Attachment hook
12 Main body
12A Casing side facing surface
12B Installation surface side facing surface
21 Rear casing
22 Front casing
23 Outer inflow opening
31 Ceiling plate
32 Labyrinth
32*d* Labyrinth
32*e* Labyrinth
33 Insect screen
34 Detection space
35 Inner inflow opening
35*a* Inner inflow opening
35*b* Inner inflow opening
35*c* Inner inflow opening
35*d* Inner inflow opening
35*e* Inner inflow opening
41 Flange portion
42 Slope portion
43 Raised portion
44 Detector body notch portion
45 Speaker accommodation portion
46 Element cover
47 Insertion hole
51 Circuit board
52 Light emitting portion
53 Light receiving portion
54 Shield
55 Switch
65 Rib
100 Alarm device
111 Threaded hole
121 Threaded hole
122 Engagement portion
211 Rear casing side facing wall
211*a* Guide recess portion
211*b* Facing surface
211*c* Facing surface
212 Rear casing side outer peripheral wall
212*a* Rear casing side end portion
213*a* Slit
213*b* Slit
214 Engagement portion
221 Front casing side exposed wall
222 Front casing side outer peripheral wall
222*a* Front casing side end portion
223 Push button
224 Threaded boss
225 Support portion
400*a* Detector body side end portion
411 Positioning recess portion
431 Arrangement recess portion
611 Component casing
612 Component casing
613 Component casing
613*a* Fixing screw
613*b* Insertion hole
614 Component casing
614*a* Fixing screw
614*b* Insertion hole
615 Component casing
616 Component casing
616*a* Outer accommodation wall
616*b* Inner accommodation wall

621 Short fin
622 Short fin
623 Short fin
631 Long fin
632 Long fin
641 Prevention piece
642 Prevention piece
651 Rib
652 Rib
653 Rib
654 Rib
655 Rib
656 Rib
657 Rib
658 Rib
659 Rib
900 Installation surface
Ar1 Area
Ar2 Area
Ar3 Area
CN1 Power connector
F1 Arrow
F2 Arrow
F3 Arrow
F4 Arrow
F5 Arrow
F21 Arrow
F22 Arrow
P1 Outer stagnation point
P2 Inner stagnation point

The invention claimed is:

1. An alarm device that is attached to an installation surface of an installation object and has an attachment surface facing the installation surface, the alarm device comprising:

detection means for detecting a detection target material included in a gas;

accommodation means for accommodating the detection means; and guide means for guiding the gas into the accommodation means; and wherein the guide means includes outer guide means for guiding the gas into the accommodation means, wherein the accommodation means includes a first inflow opening for allowing the gas to flow into the accommodation means, and wherein the outer guide means allows the gas moving along the installation surface to flow into the accommodation means through the first inflow opening;

wherein the detection means includes a partition member that defines a detection space for detecting the detection target material and a second inflow opening that allows the gas to flow into the detection space and is provided in the partition member, wherein the accommodation means includes a facing surface facing a side provided with the second inflow opening in the partition member at the outside of the detection space inside the accommodation means, wherein the alarm device further comprises inner guide means for guiding the gas moving inside the accommodation means to the detection space through the second inflow opening, and wherein the inner guide means is formed by separating the facing surface from the partition member not to be in contact with the partition member so that a space generating an air flow for guiding the gas moving inside the accommodation means to the second inflow opening is formed between the facing surface and the partition member.

2. The alarm device according to claim 1, wherein the accommodation means includes an outer wall, wherein the first inflow opening is provided in the outer wall to extend in a direction along the attachment surface, and wherein the outer guide means includes first outer guide means formed by inclining a first outer wall with respect to a direction orthogonal to a direction along the attachment surface so that a space generating an air flow for guiding the gas to the first inflow opening is formed between the installation surface and the first outer wall corresponding to a part at the side of the attachment surface with respect to the first inflow opening in the outer wall.

3. The alarm device according to claim 1, wherein the accommodation means includes an outer wall, wherein the first inflow opening is provided at the outer wall to extend in a direction along the attachment surface, and wherein the outer guide means includes second outer guide means formed by disposing an end portion of a second outer wall corresponding to a part on the opposite side to the attachment surface with respect to the first inflow opening in the outer wall in relation to an end portion of the first outer wall corresponding to a part at the side of the attachment surface with respect to the first inflow opening in the outer wall at the outside of the accommodation means in a direction along the attachment surface.

4. The alarm device according to claim 2, wherein the first outer wall is inclined in a direction along the attachment surface toward the inside of the accommodation means as it goes toward the installation surface.

5. The alarm device according to claim 1, further comprising:

attachment means including the attachment surface, provided between the installation surface and the accommodation means, and attaching the accommodation means to the installation surface, wherein the accommodation means includes an outer wall, wherein the first inflow opening is provided in the outer wall to extend in a direction along the attachment surface, wherein the accommodation means includes first accommodation means corresponding to a part at the side of the attachment surface with respect to the first inflow opening and second accommodation means corresponding to a part on the opposite side to the attachment surface with respect to the first inflow opening, and wherein a diameter of the first accommodation means is set to be larger than a diameter of the attachment means.

6. An alarm device that is attached to an installation surface of an installation object and has an attachment surface facing the installation surface, the alarm device comprising:

detection means for detecting a detection target material included in a gas;

accommodation means for accommodating the detection means; and guide means for guiding the gas into the accommodation means, wherein the accommodation means includes a first inflow opening that allows the gas to flow into the accommodation means, wherein the detection means includes a partition wall that defines a detection space for detecting the detection target material and a second inflow opening that allows the gas to flow into the detection space, wherein the guide means is a guide piece that guides the gas flowing from the first inflow opening to the second inflow opening, and wherein a front end of the guide piece at the side of the second inflow opening is not in contact with the partition wall.

7. The alarm device according to claim 6, wherein the front end of the guide piece is disposed in the vicinity of the second inflow opening.

8. The alarm device according to claim 6, wherein the second inflow opening is formed as a gap between the plurality of partition walls, and wherein the guide piece extends from the first inflow opening toward the second inflow opening on an extension line of at least one partition wall among the plurality of partition walls.

9. The alarm device according to claim 6, wherein the guide piece includes a first guide piece that extends from an outer wall of the accommodation means.

10. The alarm device according to claim 9, wherein an electric constituent arrangement area in which an electric constituent of the alarm device is disposed and an electric constituent non-arrangement area in which the electric constituent is not disposed are provided inside the accommodation means, and wherein the first guide piece is provided in the electric constituent non-arrangement area.

11. The alarm device according to claim 6, further comprising:

constituent accommodation means provided inside the accommodation means and accommodating constituents of the alarm device, wherein the guide piece includes a second guide piece that extends from the constituent accommodation means.

12. An alarm device that is attached to an installation surface of an installation object and has an attachment surface facing the installation surface, the alarm device comprising:

detection means for detecting a detection target material included in a gas;

accommodation means for accommodating the detection means; and guide means for guiding the gas into the accommodation means;

wherein the accommodation means includes an inflow opening that extends in a direction along the attachment surface and allows the gas to flow into the accommodation means, wherein the detection means includes a detection space and detects the detection target material existing in the detection space, and wherein the detection space of the detection means is provided at the side of the attachment surface in relation to the inflow opening so that any portion of the detection space is not located at the inflow opening;

wherein the alarm device further comprising:

arrangement means provided inside the accommodation means so that the detection means is disposed thereon, wherein the arrangement means includes a slope surface that is inclined with respect to a direction along the attachment surface to guide the gas flowing from the inflow opening to the detection means.

13. The alarm device according to claim 12, wherein the arrangement means is widened from the detection means to the inflow opening so that the gas passage is formed between the inflow opening and the detection means.

14. An alarm device that is attached to an installation surface of an installation object and has an attachment surface facing the installation surface, the alarm device comprising:

detection means for detecting a detection target material included in a gas;

accommodation means for accommodating the detection means; and guide means for guiding the gas into the accommodation means, wherein the accommodation means includes an inflow opening allowing the gas to flow thereinto and a slit allowing the gas to flow thereinto, wherein the inflow opening extends in a direction along the attachment surface, and wherein the slit communicates with the inflow opening while being orthogonal to the inflow opening.

15. The alarm device according to claim 14, further comprising:

a prevention piece that prevents dust included in the gas from entering the detection means, wherein the prevention piece is provided at a position facing the slit inside the accommodation means.

16. The alarm device according to claim 14, wherein the accommodation means includes constituent accommodation means for accommodating a constituent of the alarm device, wherein the constituent accommodation means forms a part of an outer wall of the accommodation means, and wherein the slit is provided at both sides of the constituent accommodation means in the outer wall of the accommodation means.

17. The alarm device according to claim 16, wherein the constituent is a battery corresponding to a power supply of the alarm device.

18. An alarm device that is attached to an installation surface of an installation object and has an attachment surface facing the installation surface, the alarm device comprising:

detection means for detecting a detection target material included in a gas;

accommodation means for accommodating the detection means; and guide means for guiding the gas into the accommodation means;

constituent accommodation means for accommodating a constituent of the alarm device other than the detection means;

wherein the accommodation means includes an inflow opening that allows the gas to flow thereinto and accommodates the detection means and the constituent accommodation means, and wherein the constituent accommodation means includes the guide means for guiding the gas from the inflow opening to the detection means and extending from an outer wall of the accommodation means to the detection means;

wherein the constituent accommodation means further includes an accommodation wall that defines a constituent accommodation space accommodating the constituent, and wherein the guide means is the accommodation wall;

wherein the constituent accommodation means includes first constituent accommodation means in which a first portion of the accommodation wall forms the outer wall of the accommodation means, and wherein the guide means is a second portion other than the first portion in the accommodation wall of the first constituent accommodation means.

19. The alarm device according to claim 18, wherein the constituent accommodation means includes second constituent accommodation means in which the entire accommodation wall is separated from the outer wall of the accommodation means, wherein the second constituent accommodation means includes a combination wall that combines the accommodation wall of the second constituent accommodation means with the outer wall of the accommodation means, and wherein the guide means is the combination wall.

20. The alarm device according to claim 19, wherein the second constituent accommodation means includes a protrusion that protrudes from the accommodation wall of the second constituent accommodation means toward the detection means, and wherein the guide means is the protrusion.

21. An alarm device that is attached to an installation surface of an installation object and has an attachment surface facing the installation surface, the alarm device comprising:

detection means for detecting a detection target material included in a gas;

accommodation means for accommodating the detection means; and arrangement means provided inside the accommodation means so that the detection means is disposed thereon, wherein the accommodation means includes a first inflow opening configured to allow the gas to flow from outside of the accommodation means into inside of the accommodation means, wherein the detection means includes a second inflow opening configured to allowing the gas flowed into the inside of the accommodation means through the first inflow opening into inside of the detection means, and wherein the arrangement means includes a slope surface configured to direct the gas from the first inflow opening to the second inflow opening, the slope surface being inclined with respect to a direction along the attachment surface.

22. The alarm device according to claim 21, wherein the second inflow opening is disposed closer to the attachment surface than the first inflow opening.

23. The alarm device according to claim 22, the accommodation means includes first accommodation means for covering the detection means from the side of the attachment surface and second accommodation means for covering the detection means from the opposite side to the attachment surface, wherein the first accommodation means includes a recess portion which is recessed from the opposite side of the attachment surface toward the attachment surface, wherein the detection means includes a detector cover configured to define detection space for detecting the detection target material, and wherein at least a part of the detector cover is disposed in the recess portion.

24. The alarm device according to claim 23, comprises an attachment base fixed to the attachment surface for attaching the accommodation means to the installation surface, wherein the attachment base includes an opening, and wherein at least a part of the recess portion is disposed in the opening.

* * * * *